US009713745B2

(12) United States Patent
Rogers

(10) Patent No.: US 9,713,745 B2
(45) Date of Patent: Jul. 25, 2017

(54) PORTABLE CALISTHENICS EXERCISE DEVICE

(71) Applicant: Kim Rogers, Stanwood, WA (US)

(72) Inventor: Kim Rogers, Stanwood, WA (US)

( * ) Notice: Subject to any disclaimer, the term of this patent is extended or adjusted under 35 U.S.C. 154(b) by 240 days.

(21) Appl. No.: 13/907,067

(22) Filed: May 31, 2013

(65) Prior Publication Data

US 2013/0324383 A1 Dec. 5, 2013

Related U.S. Application Data

(60) Provisional application No. 61/653,697, filed on May 31, 2012.

(51) Int. Cl.
*A63B 26/00* (2006.01)
*A63B 21/002* (2006.01)
(Continued)

(52) U.S. Cl.
CPC ..... *A63B 26/00* (2013.01); *A63B 21/00047* (2013.01); *A63B 21/068* (2013.01);
(Continued)

(58) Field of Classification Search
CPC ... A63B 26/00; A63B 21/068; A63B 21/1426; A63B 23/0211; A63B 21/1419; A63B 21/00047; A63B 23/1227; A63B 23/0216; A63B 23/0238; A63B 23/0355; A63B 21/1469; A63B 23/1218; A63B 23/0494; A63B 23/1236; A63B 2208/028; A63B 2210/50; A63B 2208/0257; A63B 2208/0247; A63B 2023/0411; A63B 2023/006; A63B 2208/0223; A63B 2225/09; A63B 2208/0252; A63B 2208/0233; A63B 2225/093; A63B 2208/0204; A63B 1/00; A63B 3/00; A63B 17/00; A63B 17/02; A63B 17/04; A63B 21/0005; A63B 21/00054; A63B 26/003; A63B 2026/006; A63B 71/0036;
(Continued)

(56) References Cited

U.S. PATENT DOCUMENTS 2,666,640 A * 1/1954 Jennings, Sr. ..... 482/141
2,817,387 A * 12/1957 Blake ..... 135/67
(Continued)

*Primary Examiner* — Joshua Lee
(74) *Attorney, Agent, or Firm* — Dean Craine

(57) ABSTRACT

A device for supporting an exerciser performing callisthenic exercises that includes a right and left, rigid, upright frame supports and an intermediate fork assembly. The fork assembly is adjustable in length and linked to the front sections of the two frame supports. Each frame support is angled inward to provide greater stability. The rear sections of the frame supports are detached and may be rotated laterally to reposition the gripping surfaces on the two frame supports and to adjust the size of the exercise space located between the two frame supports to accommodate different individuals and exercises. Each frame support includes an adjustable front leg and an adjustable rear leg that allows height adjustment of each frame support. The device may include one or two pairs of handles attached to the two frame supports, and a suspension seat and one or two horizontal bars extending between the two frame supports.

20 Claims, 47 Drawing Sheets

(51) Int. Cl.

| | |
|---|---|
| ***A63B 21/068*** | (2006.01) |
| ***A63B 21/00*** | (2006.01) |
| ***A63B 23/12*** | (2006.01) |
| ***A63B 23/02*** | (2006.01) |
| ***A63B 23/035*** | (2006.01) |
| ***A63B 23/04*** | (2006.01) |
| *A63B 23/00* | (2006.01) |

(52) U.S. Cl.

CPC ..... *A63B 21/4009* (2015.10); *A63B 21/4013* (2015.10); *A63B 21/4035* (2015.10); *A63B 23/0211* (2013.01); *A63B 23/0216* (2013.01); *A63B 23/0238* (2013.01); *A63B 23/0355* (2013.01); *A63B 23/0494* (2013.01); *A63B 23/1218* (2013.01); *A63B 23/1227* (2013.01); *A63B 23/1236* (2013.01); *A63B 2023/006* (2013.01); *A63B 2023/0411* (2013.01); *A63B 2208/0204* (2013.01); *A63B 2208/028* (2013.01); *A63B 2208/0223* (2013.01); *A63B 2208/0233* (2013.01); *A63B 2208/0247* (2013.01); *A63B 2208/0252* (2013.01); *A63B 2208/0257* (2013.01); *A63B 2210/50* (2013.01); *A63B 2225/09* (2013.01); *A63B 2225/093* (2013.01)

(58) Field of Classification Search

CPC ..... A63B 2210/52; A63B 2210/54; A63B 2210/56; A63B 2210/58; A61H 3/00

USPC ..... 482/133–139, 141–144; 135/67

See application file for complete search history.

(56) References Cited

U.S. PATENT DOCUMENTS

| | | | | | |
|---|---|---|---|---|---|
| 3,968,810 | A * | 7/1976 | Thomas | 135/67 |
| 3,993,349 | A * | 11/1976 | Neufeld et al. | 297/6 |
| 4,135,535 | A * | 1/1979 | Thomas | 135/67 |
| 4,314,576 | A * | 2/1982 | McGee | 135/67 |
| 4,621,804 | A * | 11/1986 | Mueller | 280/87.041 |
| 4,850,589 | A * | 7/1989 | Block | 482/36 |
| 4,941,497 | A * | 7/1990 | Prather et al. | 135/67 |
| 4,993,446 | A * | 2/1991 | Yarbrough | 135/67 |
| 4,995,412 | A * | 2/1991 | Hirn et al. | 135/67 |
| 5,058,912 | A * | 10/1991 | Harroun | 280/87.021 |
| 5,221,246 | A * | 6/1993 | Torii | 482/144 |
| 5,255,696 | A * | 10/1993 | Leonard | 135/67 |
| 5,961,430 | A * | 10/1999 | Zuckerman et al. | 482/142 |
| 6,248,048 | B1 * | 6/2001 | Zuckerman et al. | 482/142 |
| 6,453,921 | B1 * | 9/2002 | Rost | 135/67 |
| 6,685,601 | B1 * | 2/2004 | Knapp | 482/104 |
| 6,692,417 | B2 * | 2/2004 | Burrell | 482/142 |
| 6,733,018 | B2 * | 5/2004 | Razon | 280/87.021 |
| 7,144,353 | B2 * | 12/2006 | Sjuragari | 482/142 |
| 7,373,942 | B1 * | 5/2008 | Yeager | 135/67 |
| 7,488,277 | B1 * | 2/2009 | Knapp | 482/104 |
| 7,703,465 | B2 * | 4/2010 | Diamond | 135/67 |
| 7,955,238 | B2 * | 6/2011 | Dokshutsky | 482/129 |
| 8,166,988 | B1 * | 5/2012 | Martin | 135/67 |
| 2008/0135078 | A1 * | 6/2008 | Hsieh | 135/67 |

* cited by examiner

PORTABLE CALISTHENICS EXERCISE DEVICE

This utility patent application is based upon U.S. provisional patent application (Application No. 61/653,697) filed on May 31, 2012.

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention relates to physical exercising equipment, and more particularly to physical exercising equipment used for performing different callisthenic exercises.

2. Description of the Related Art

Many individuals prefer doing calisthenics rather than running or walking or working out using a treadmill, an elliptical machine, or a stationary bicycle. Calisthenics are types of exercises comprising a variety of simple, often rhythmical, movements of specific body parts or movements of the entire body against the force of gravity. They typically include push-ups, sit-ups, jumping jacks, and various leg, back and abdominal stretches. They are normally performed when standing upright, when sitting or when laying in a prone position or in a supine position. An important aspect of most callisthenic exercises is that every individual has a unique autonomy, different athletic skills and different medical and health conditions that allow or prevent the performance some calisthenics exercises.

Most individuals have a particular style or technique when performing callisthenic exercises For example, woman usually perform push-ups slowly with their legs bent so their knees touch the ground while men usually perform push-ups quickly with their legs straight so their toes touch the ground. Some individuals prefer performing push-ups with their hands spaced shoulder width apart while others prefer performing push-ups with their hands spaced outside their shoulders.

Handicapped individuals restricted to a wheelchair often benefit from calisthenics exercises. These individuals find it difficult to move back and forth from the wheelchair to the floor. Also, because elevated exercise bars and weight benches are usually fixed objects that are difficult to access when sitting in a wheelchair.

What is needed is a portable device that can be used by individuals to perform different callisthenic exercises and can be used by individuals with different athletic skills, different autonomies, and have different physical and medical conditions.

SUMMARY OF THE INVENTION

An important aspect of the invention disclosed there is the discovery that a device is needed that is adjustable so that different individuals may perform different callisthenic exercises best suited for them. Such a device should be easily adjustable so it may be used by both advanced and beginning exercisers and by handicapped and non-handicapped individuals.

Disclosed is a portable device designed for performing different callisthenic exercises, such as stretching, bending, twisting, pushups, leg lifts, dips, etc. The device allows the exerciser to increase his body movement without using a back support or a neck support, such as a padded board, or when lying on the floor. The device challenges strength training to all extremes using only muscle movement and flexibility of every exercise being performed for every person, along with the development for increasing flexibility of muscle tissues by the stretching movements for the muscle groups being used during the persons exercise fitness training being performed.

The device includes a right frame support and a left frame support linked by an intermediately located fork assembly. The right and left frame supports are slight angled inward so they converge to provide greater stability and support when used. The front sections of the two frame supports are pivotally connected to the fork assembly. In one embodiment, the fork assembly includes a length adjustable upper connector bar and a length adjustable lower connector bar that allows the spacing between the two front sections to be adjusted.

Each frame support includes an upper support bar and a lower support bar. In one embodiment, the upper support bar is curved upward over a straight lower support bar. Each frame support includes a front bar that is pivotally connected to the front fork. The rear sections of the two frame supports are detached from each other thereby allowing them to be selectively spaced apart and form a V-shaped exercise space between the two frame supports. When exercising, the exerciser adjusts the angles of the two frame supports so they may support the exerciser's hands, arms, legs, and feet at a desired position required for the exercise. Sometimes, the frame supports are moved to allow a wheelchair to be positioned in the V-shaped space. When exercising, the exerciser positions himself partially or entirely inside the V-shaped exercise space and uses the two frame supports to support his hands, arms, legs, and the upper and lower torsos. By moving the two rear sections inward or outward, the exerciser can adjust size and shape of the V-shaped exercise space.

Each frame support may include a length adjustable front leg and a length adjustable rear leg that allow the exerciser to selectively lower or raise the front section and rear section respectively.

Attached to upper support bar and the lower bar are optional collars made of soft foam that may be used as hand grips or shoulder protection pads. Also, attached to each frame support is a first handle. In one embodiment, the first handle is L-shaped and can be selectively rotated and locked in a fixed position for a desired exercise. The device may also includes a pair of second handles attached to the two frame supports, a suspended seat, and one or two horizontal bars that selectively attach to the two frame supports and extend across the exercise area.

When performing a callisthenic exercise, the exerciser may stand upright or lay in a supine or prone position. The exerciser may use the suspension seat and positioned himself in a sitting position between the two frame supports. The exerciser may grip the upper curved bars, the lower curved bars, the set of first handles, the set of second handles. When one or both horizontal bars are used, the exerciser may use them as support structures for bending around. After performing a callisthenic exercise, the exerciser can easily adjust the spacing of the front fork assembly, the lengths of the front and rear legs, and the angles of the handles, and remove the suspension seat or horizontal bars to perform the next desired exercise.

DESCRIPTION OF THE PREFERRED EMBODIMENT(S)

Figure 1:
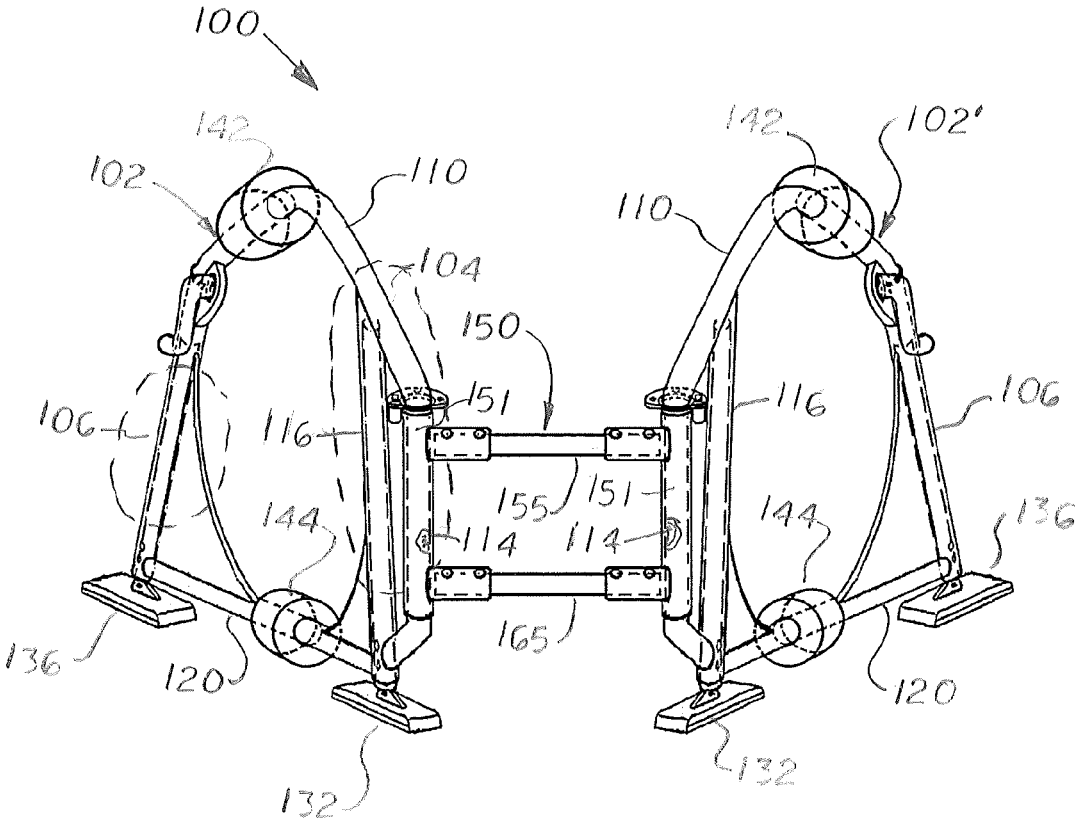
FIG. 1 is a front perspective view of the first embodiment of the portable physical exercise device shown and described.

Referring to the accompanying FIGS. 1-12, there is shown a portable device 100 designed for performing different callisthenic exercises, such as stretching, bending, twisting, push ups, leg lifts, dips, etc. More specifically, FIGS. 1-6 is a front perspective view of the portable physical exercise device 100 that includes a rigid, right frame support 102 and a rigid left frame support 102' connected to an intermediate front fort assembly 150.

Each frame support 102, 102' includes an upper support bar 110 and a lower support bar 120. The upper support bar 110 is U-shaped and configured to curve upward over the straight lower support bar 120. The upper support bar 110 includes a front tube 116 that connects to the front end of the lower support bar 120.

Extending forward from the upper support bar 110 and the lower support bar 120 is a front extension 111. Each front extension 111 includes upper and lower extension arm 112, 113, respectively, and a vertical arm 114 disposed between the two extension arms 112, 113.

The fork assembly 150 links the two front sections of the frame supports 102, 102' together. As discussed further below, the fork assembly 150 is adjustable in length and allows each front frame 110 to rotate independently.

The fork assembly 150 includes two outer tubes 151 that are coaxially aligned and extend over the vertical arms 114 on the front extensions 11. Attached to each outer tube 151 are two stubs 157, 167 and 159, 169. A tube 155 and 165 is extended between the stubs 157, 159 and 167, 169, respectively, on the adjoining outer tube tubes 151. The tubes 155, 165 and the stubs 155, 165 may have holes and pins that allow the exerciser to adjust the length of the fork assembly 150. Mounted on each upper support bar 110 is a hinge 162 with a plurality of holes 163 formed therein that receives an upward extending pin 164 with a laterally extending handle 166. The pin 164 extends upward from the outer tube 151 and engages one of the holes 163 as shown FIG. 6.

The rear sections of the two frame supports 102, 102' are both detached allowing them to be selectively spaced apart and forming a V-shaped exercise space 20 between the two frame supports 102, 102'. When exercising, the exerciser 300 adjusts the angles of the two frame supports 102, 102' so they may support the exerciser's hands, arms, legs, and feet at a desired position required for a particular exercise. Sometimes, the frame supports 102, 102' are moved to allow a wheelchair to be positioned in the V-shaped exercise space 20. When exercising, the exerciser 300 positions himself partially or entirely inside the V-shaped exercise space 20 and uses the two frame supports 102, 102' to support his hands, arms, legs, and the upper and lower torsos. By moving the two rear sections of each frame support 102, 102' inward or outward, the exerciser 300 can easily adjust size and shape of the V-shaped exercise space 20.

Attached to upper support bar and the lower bar are optional collars 142, 144, respectively, made of soft foam that may be used as hand grips or shoulder protection pads.

Each frame support 102, 102' includes an optional front adjustable leg 134 and an optional rear adjustable leg 138. In the embodiment shown herein, the upper frame bar 110 is hollow and the leg 116 is hollow thereby allowing the legs 134, 138 to extend. Suitable holes and pins are formed on the legs and on the bar 110 and the leg 116 that allows the exerciser 300 to adjust their lengths and elevate the front and rear sections of the device 100.

Figure 2:
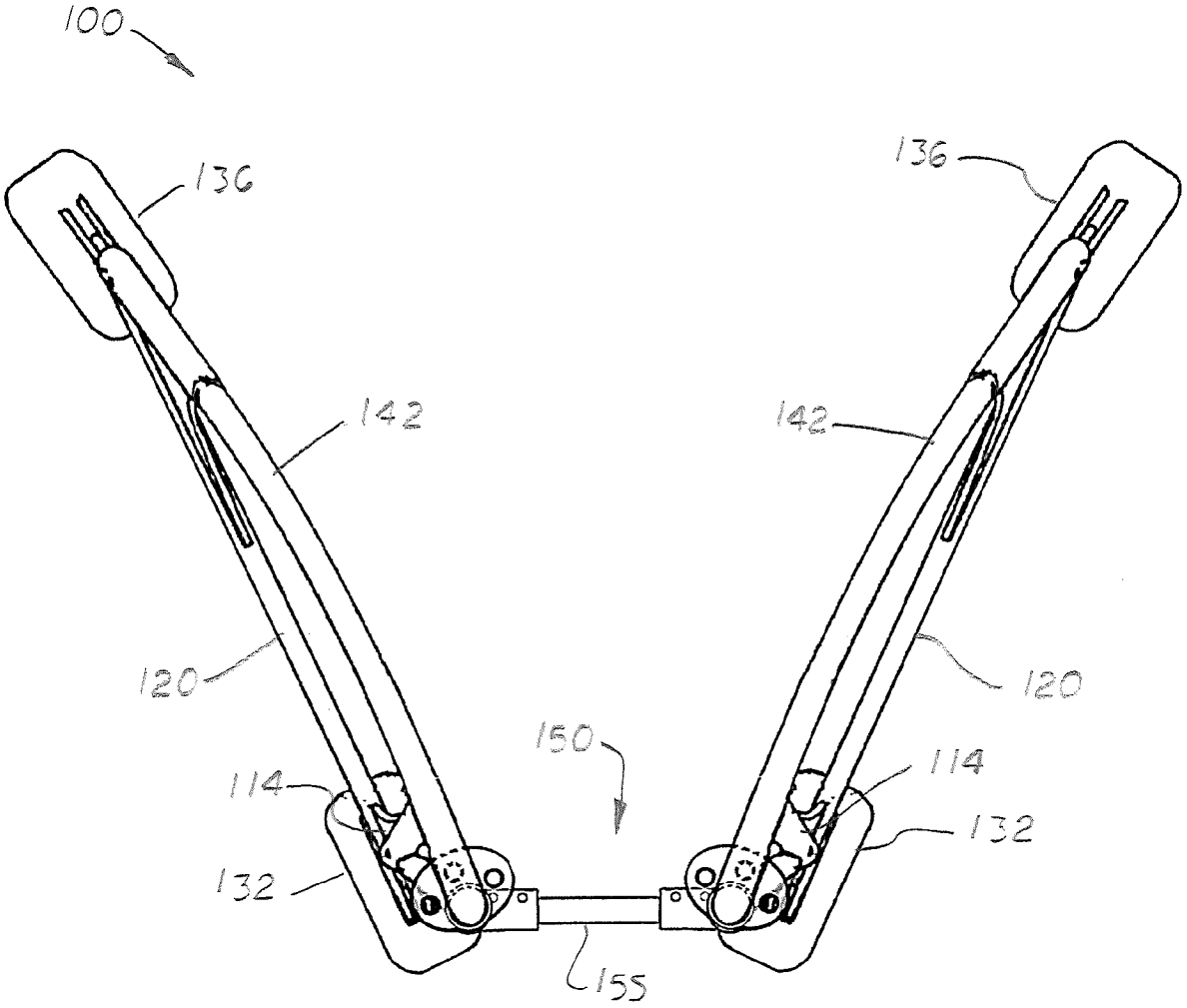
FIG. 2 is a top plan view of the portable physical exercise device with the two frame supports configured in a lateral expanded configuration.
Figure 3:
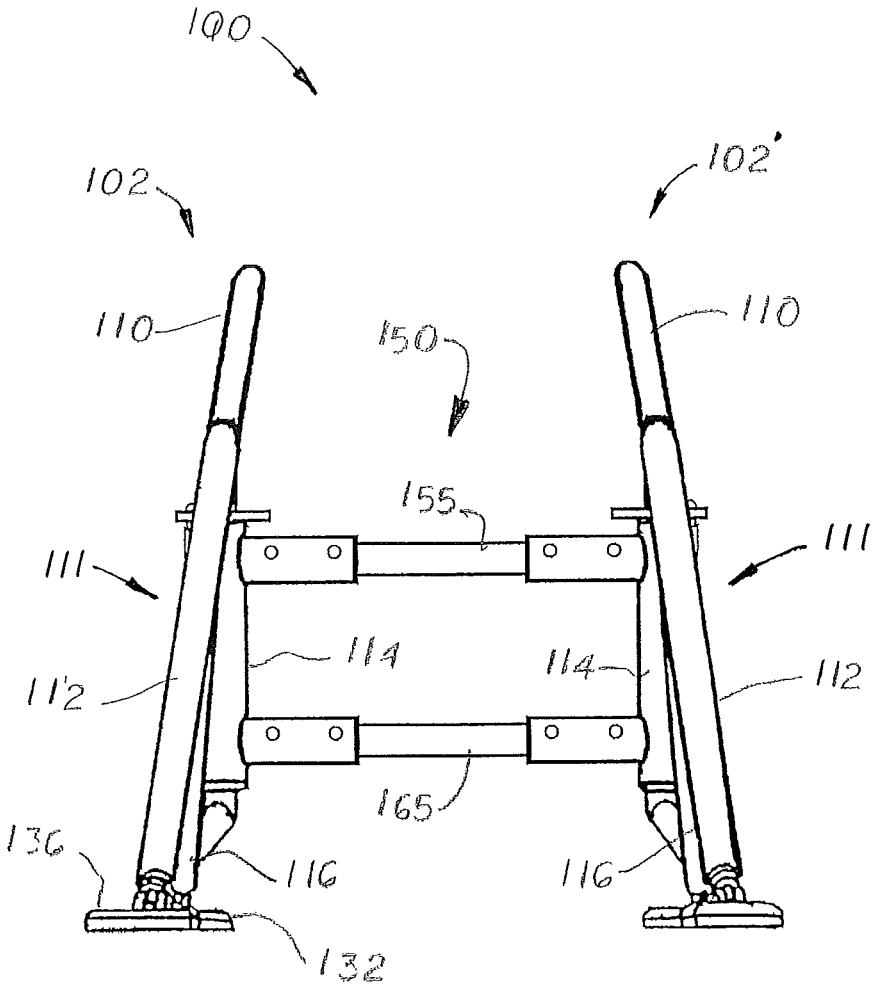
FIG. 3 is a rear elevational view of the portable physical exercise device.
Figure 4:
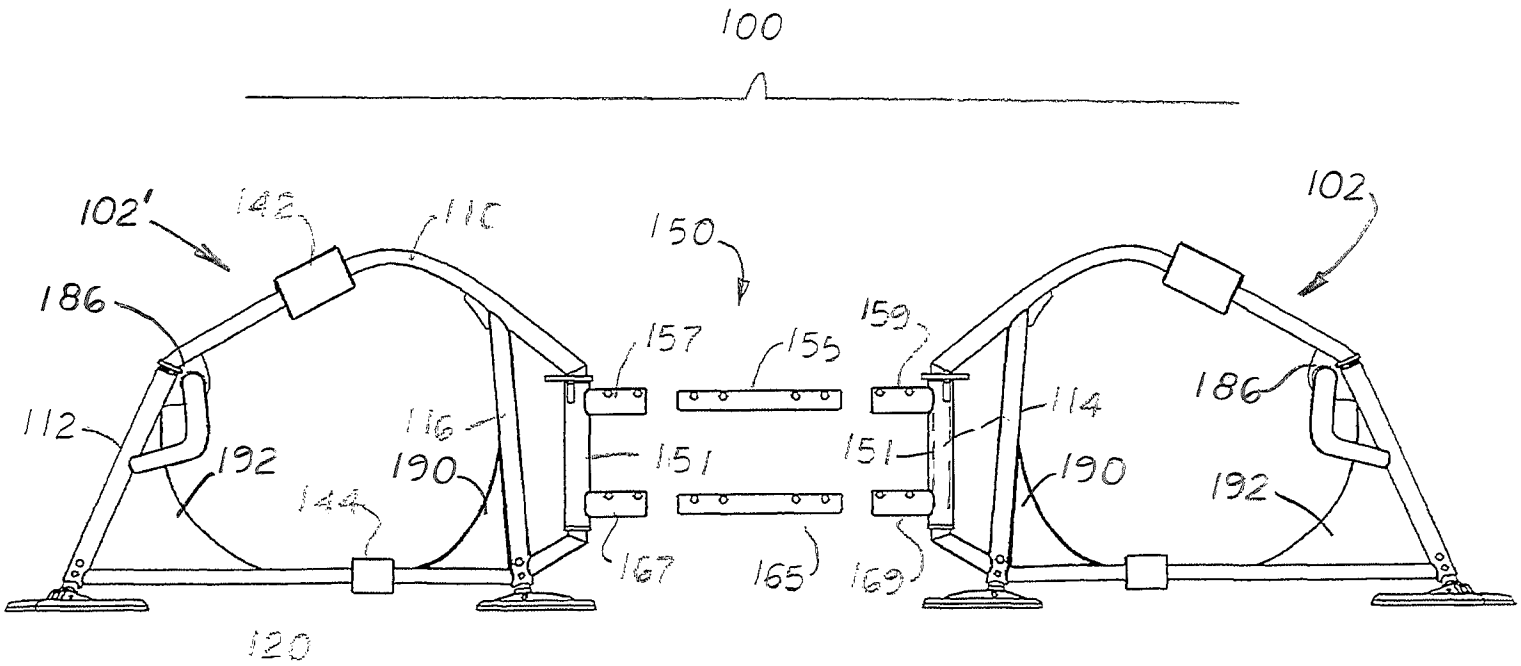
FIG. 4 is a partially exploded, front elevational view of the portable physical exercise device.
Figure 5:
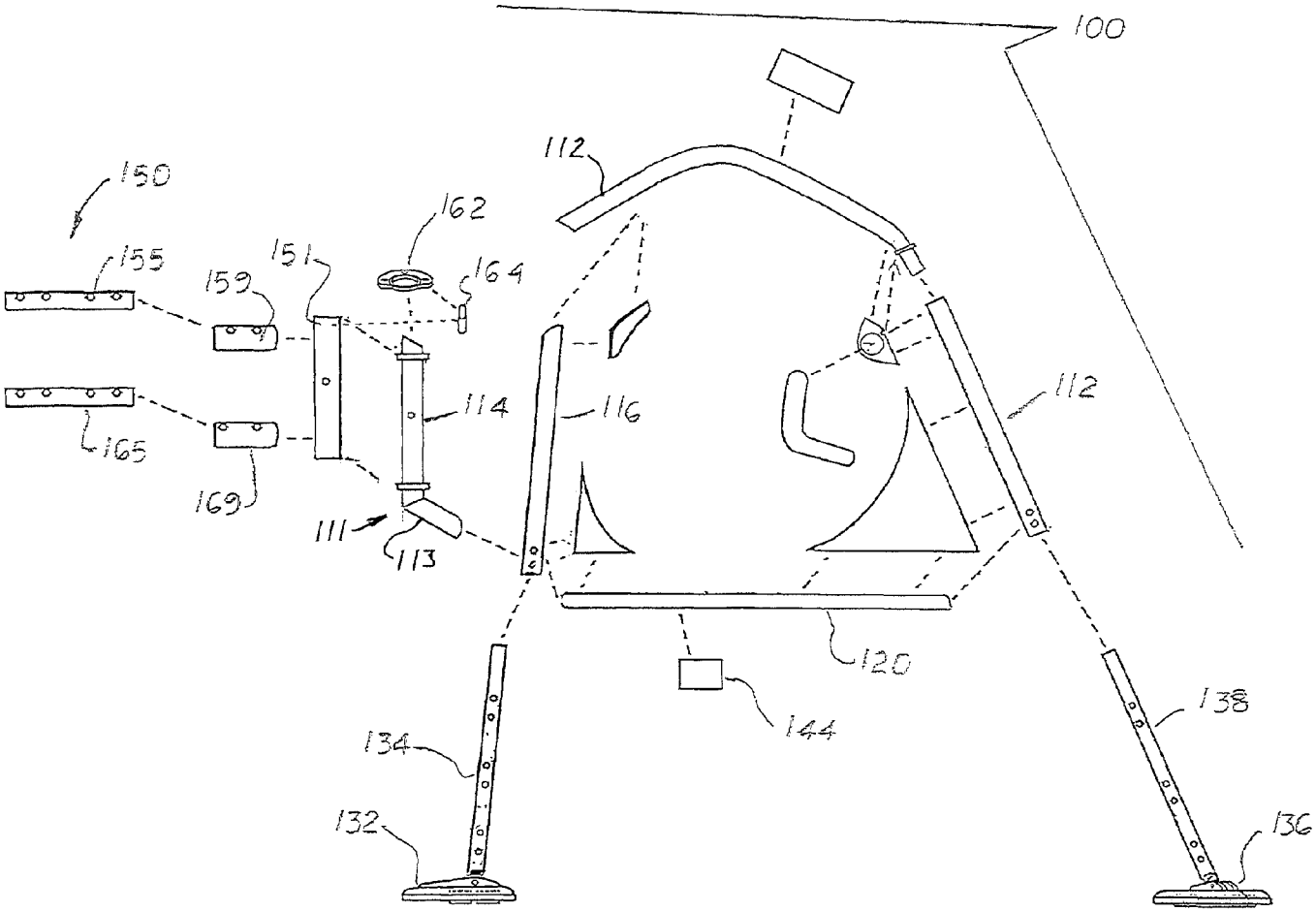
FIG. 5 is an explode side elevational view of a side frame support.
Figure 6:
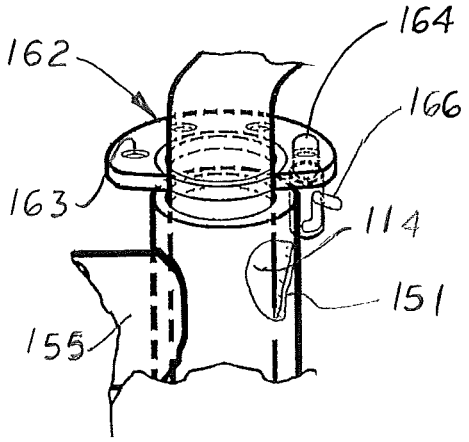
FIG. 6 is an illustration of a hinge on the fork assembly.
Figure 7:
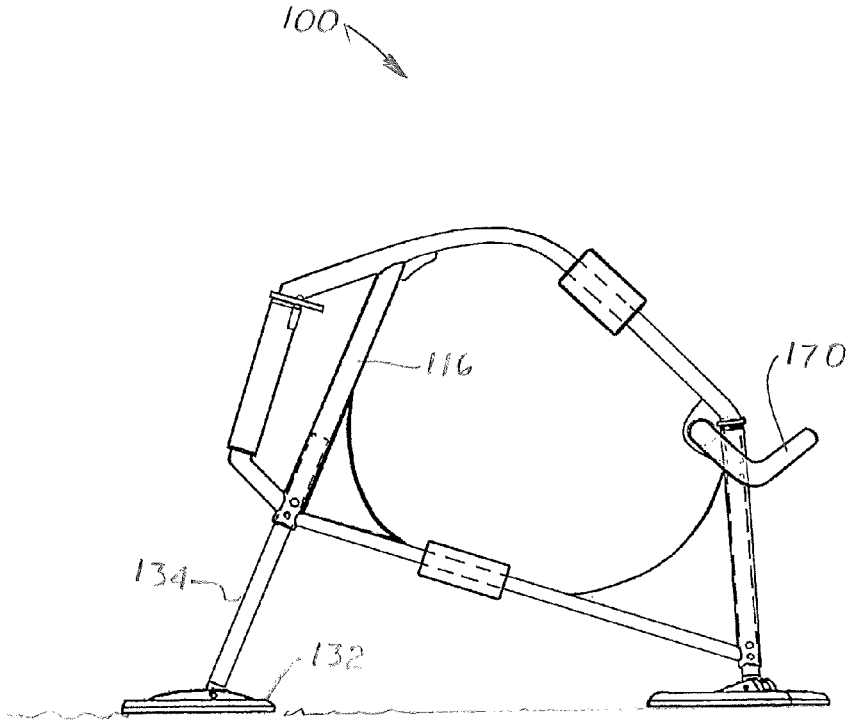
FIG. 7 is a side elevational view of a frame support with the front leg elevated.
Figure 8:
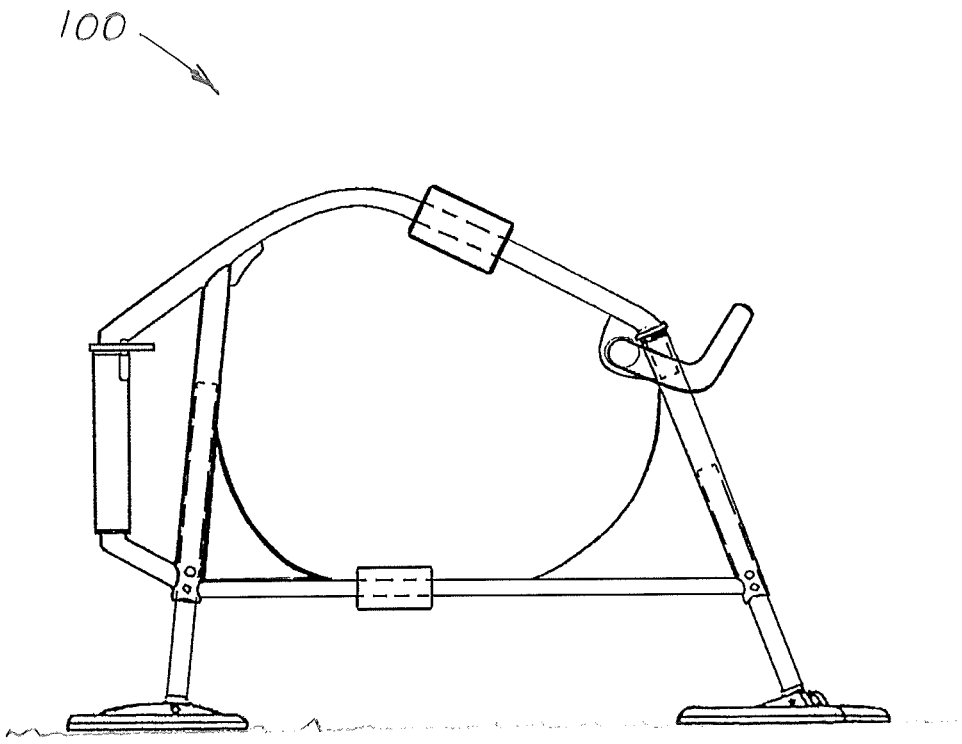
FIG. 8 is a side elevational view of a frame support with the front and rear legs disposed so the frame support is level
Figure 9:
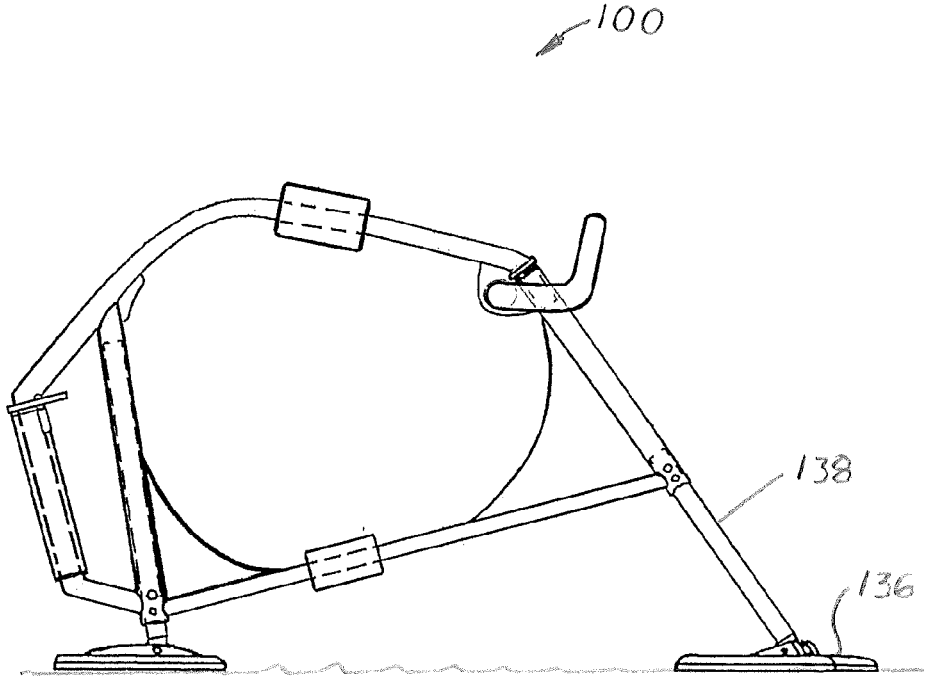
FIG. 9 is a side elevational view of a frame support with the rear leg elevated.

As shown in FIGS. 2 and 3, each frame support 102, 102' is angled inward so the device 100 securely supports the full weight of the exercising 300. Attached to the lower end of each front and rear leg 134, 138 is a pivoting foot pad 132, 136, respectively. Attached or formed on the bottom of each foot pad 132, 136 is an optional layer made of fiction enhancing material, i.e. rubber.

Figure 10:
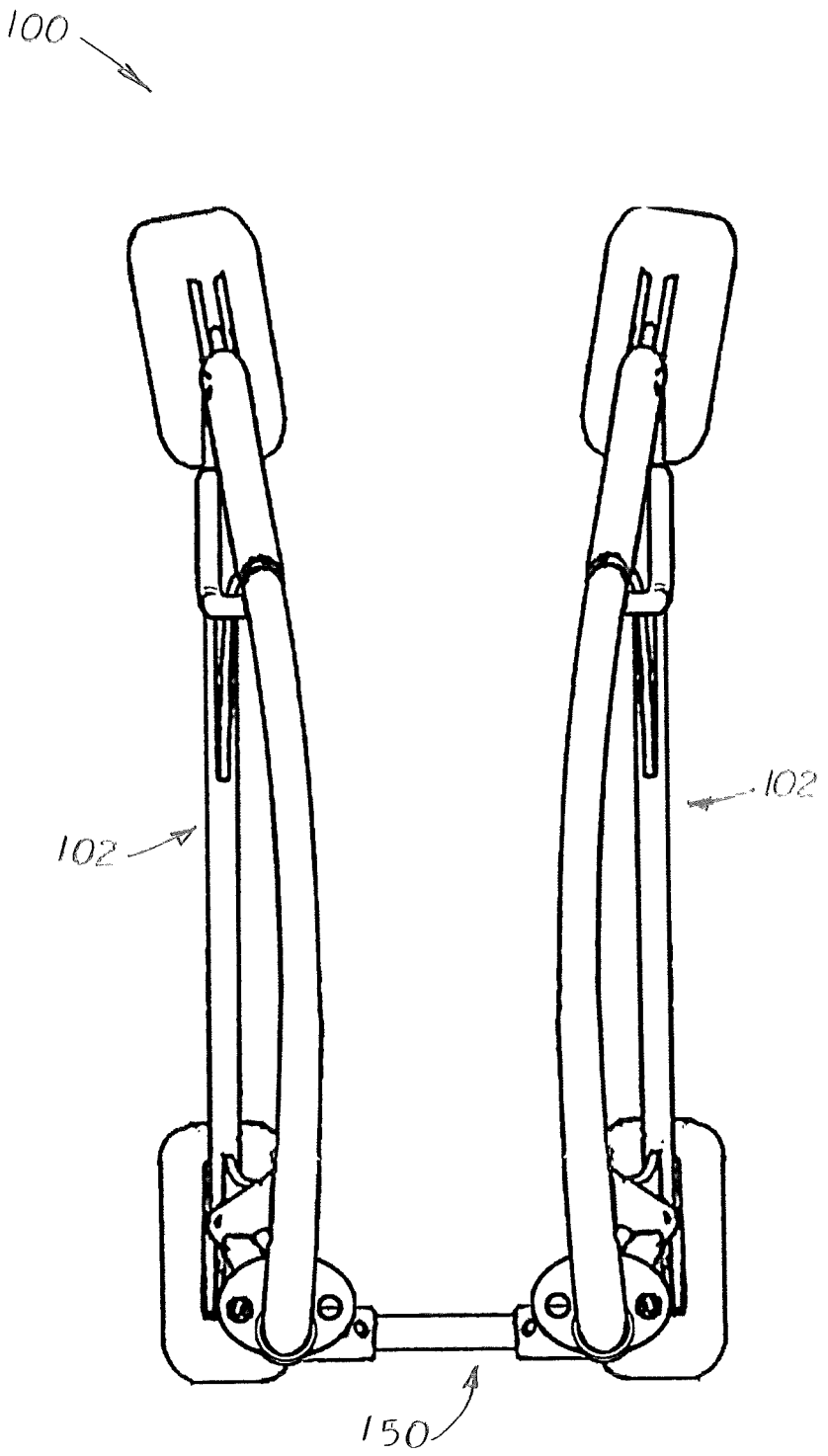
FIG. 10 is a top plan view of the device in a semi-collapsed configuration with the two frame supports being parallel to each other and perpendicular to the fork assembly.
Figure 11:
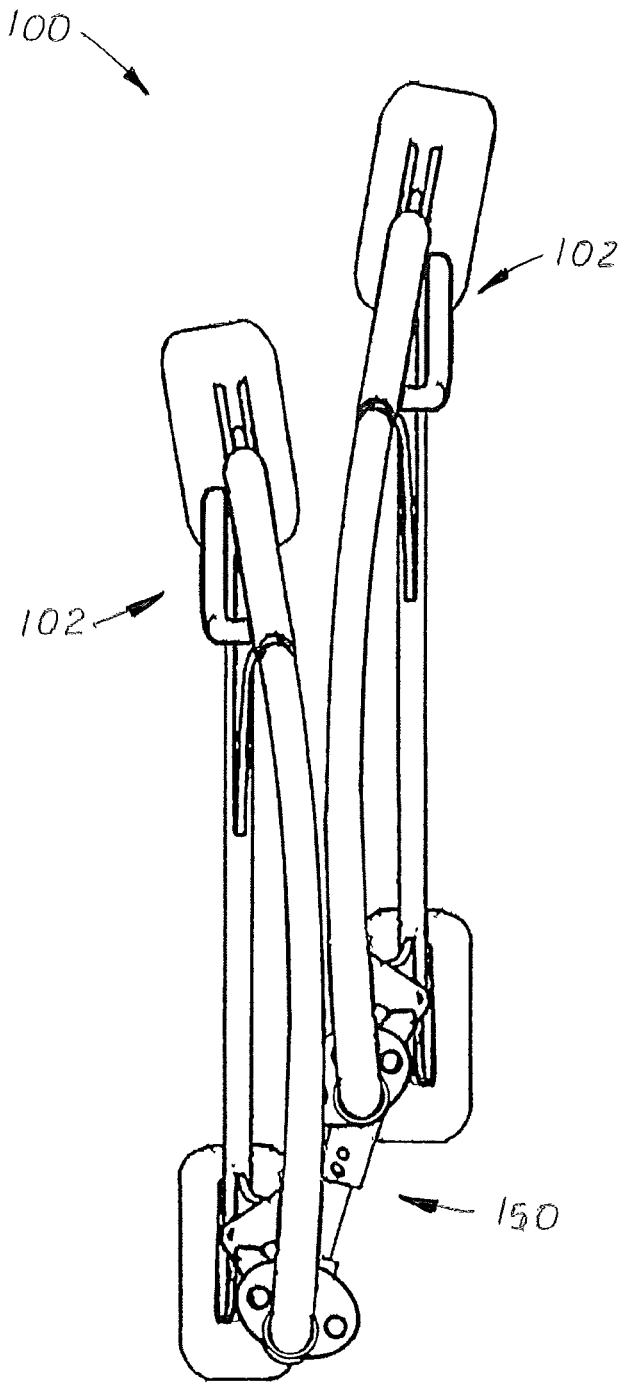
FIGS. 11 and 12 are top plan views of the device in two possible fully collapsed configurations.
Figure 12:
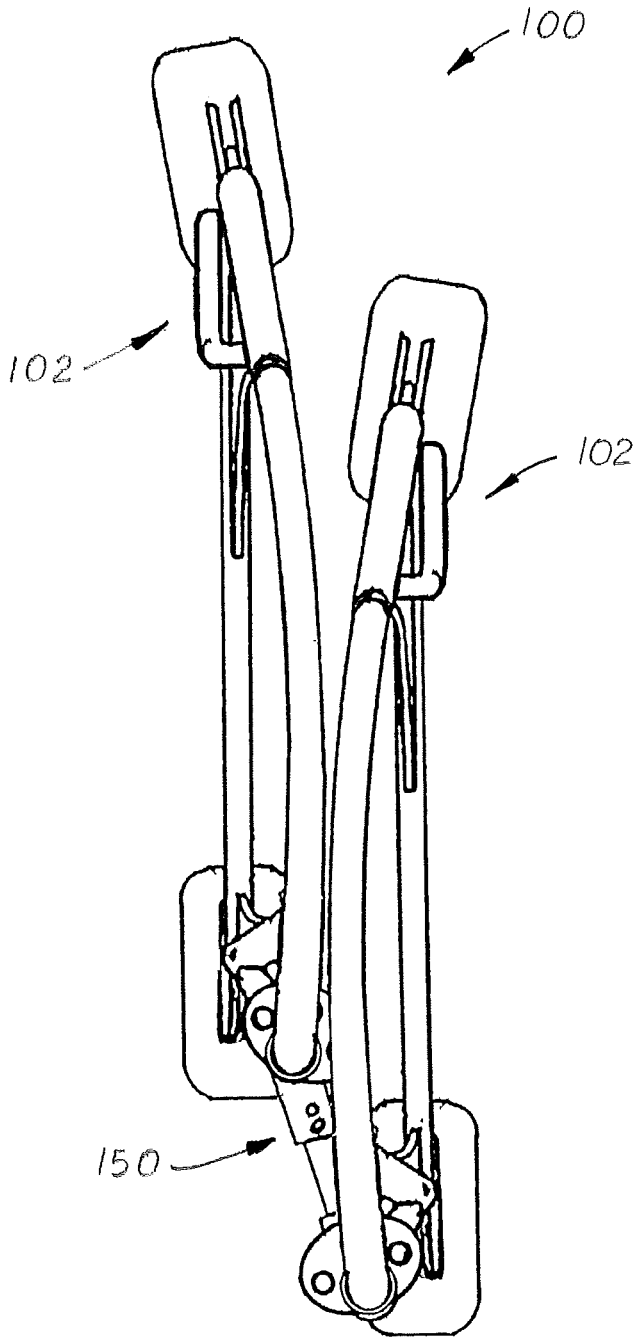
Figure 13:
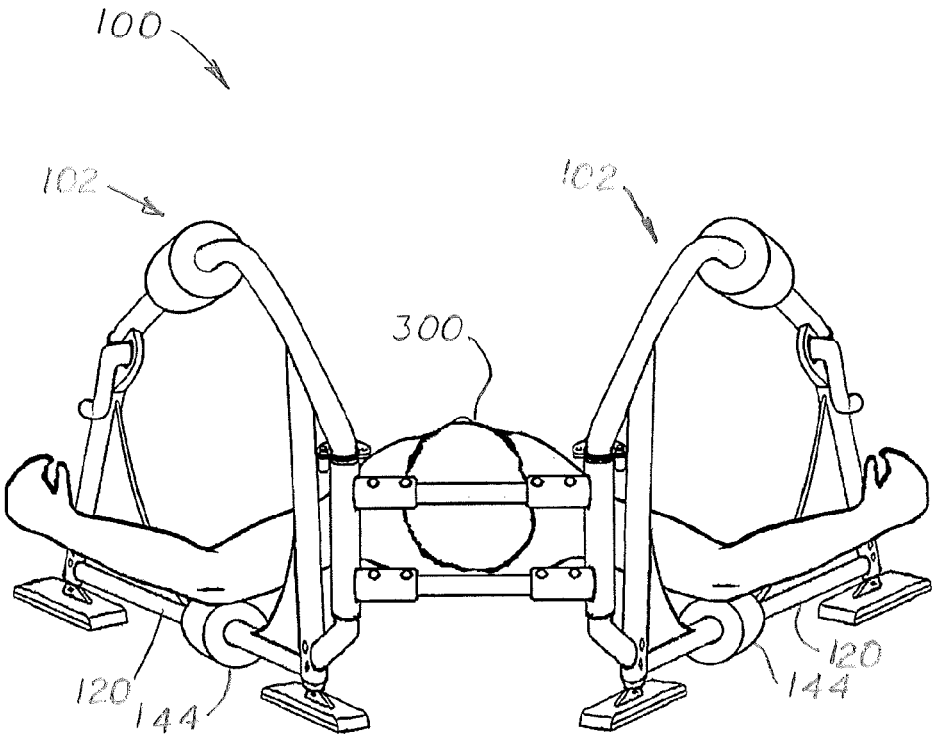
FIG. 13 is an illustration of an exerciser positioned in the exercise space between the two frame supports and in a supine position with the two arms extending laterally to position the two triceps over the lower support members.
Figure 14:
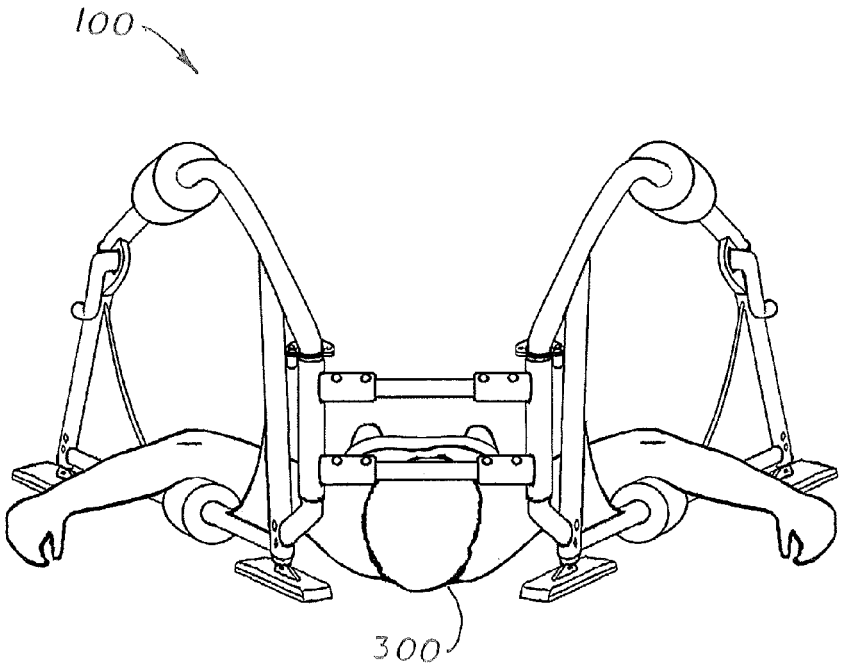
FIG. 14 is an illustration of an exerciser positioned in the exercise space created between the two frame supports and in a prone position with the two biceps positioned over the two lower support bars.
Figure 15:
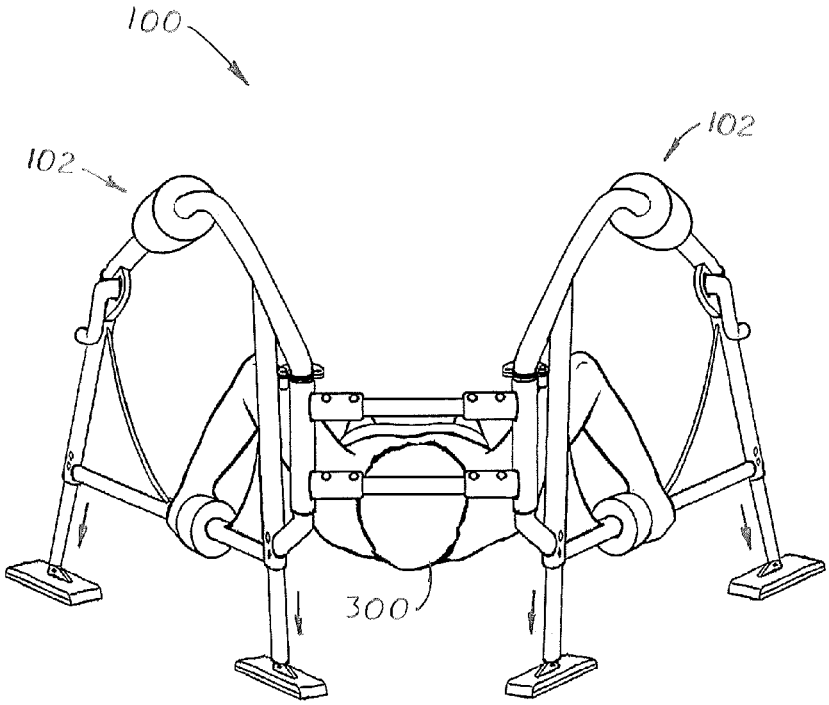
FIG. 15 is an illustration of an exerciser positioned in the exercise space between the two frame supports and in a prone position with the exerciser's arms partially flexed and the hands are positioned on the two lower support bars.
Figure 16:
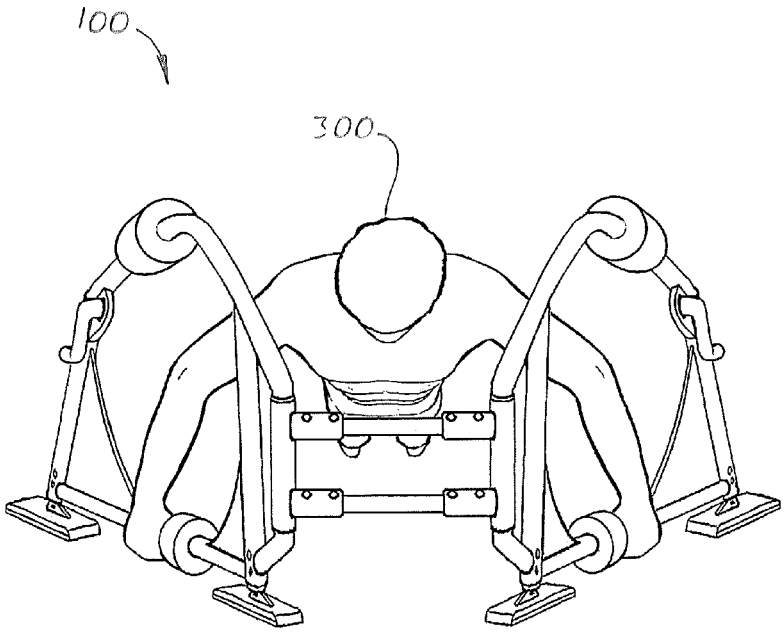
FIG. 16 is an illustration of an exerciser positioned in the exercise space between the two frame supports and in a prone position with the exerciser's arms extended and the hands are positioned on the two lower support bars.
Figure 17:
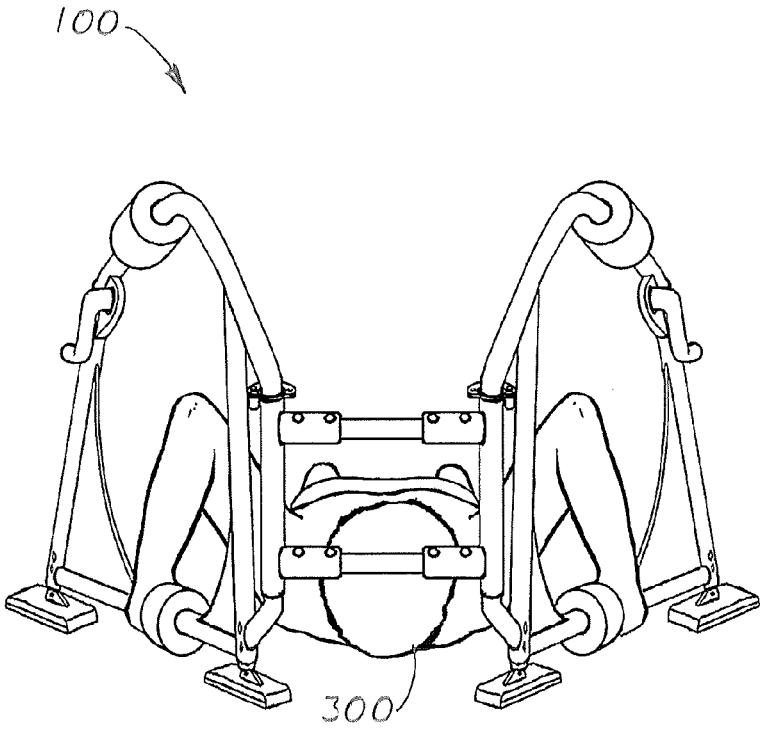
FIG. 17 is an illustration of an exerciser positioned in the exercise space between the two frame supports and in a prone position with the exerciser's arms relaxed and bent while the hands are positioned on the two lower support bars.
Figure 18:
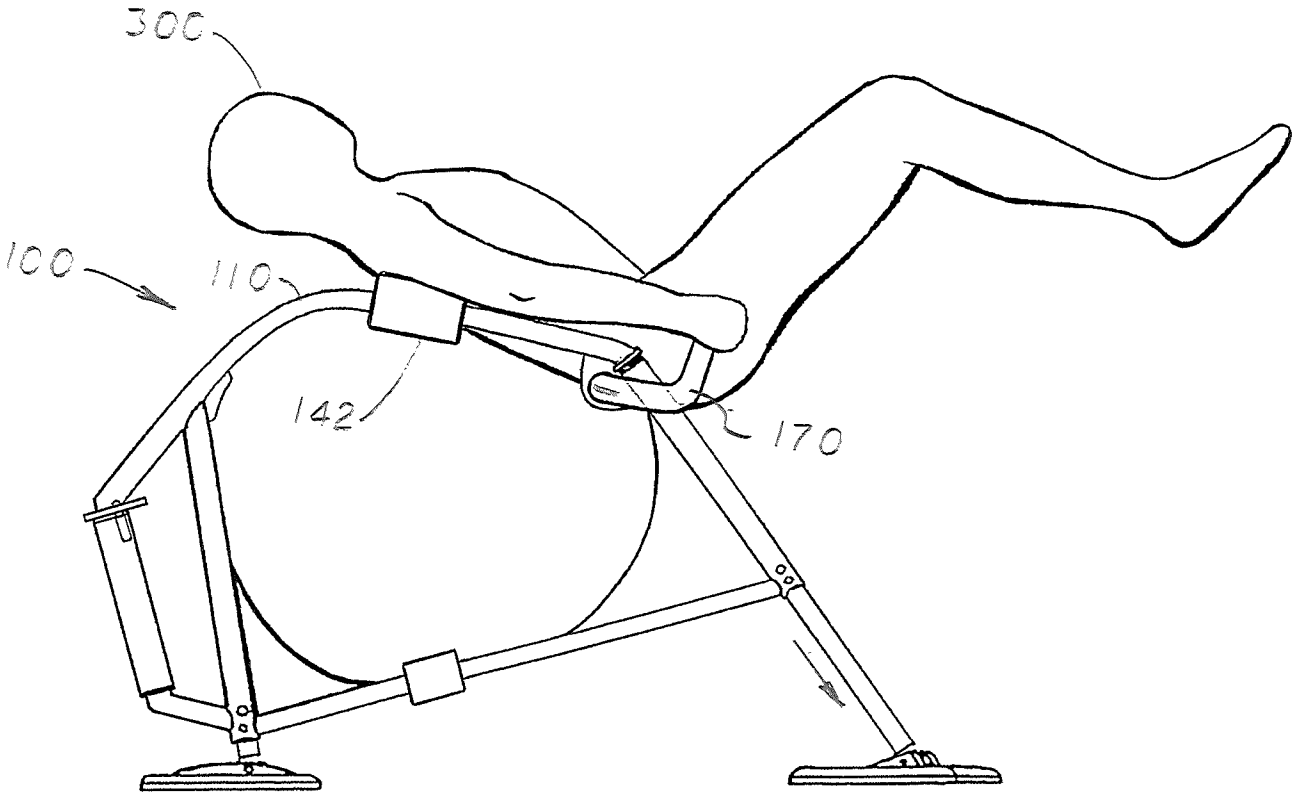
FIG. 18 is an illustration of an exerciser in a supine position and supported by the two upper support bars, gripping the first handles and performing abdominal crunches with the legs extended outward.
Figure 19:
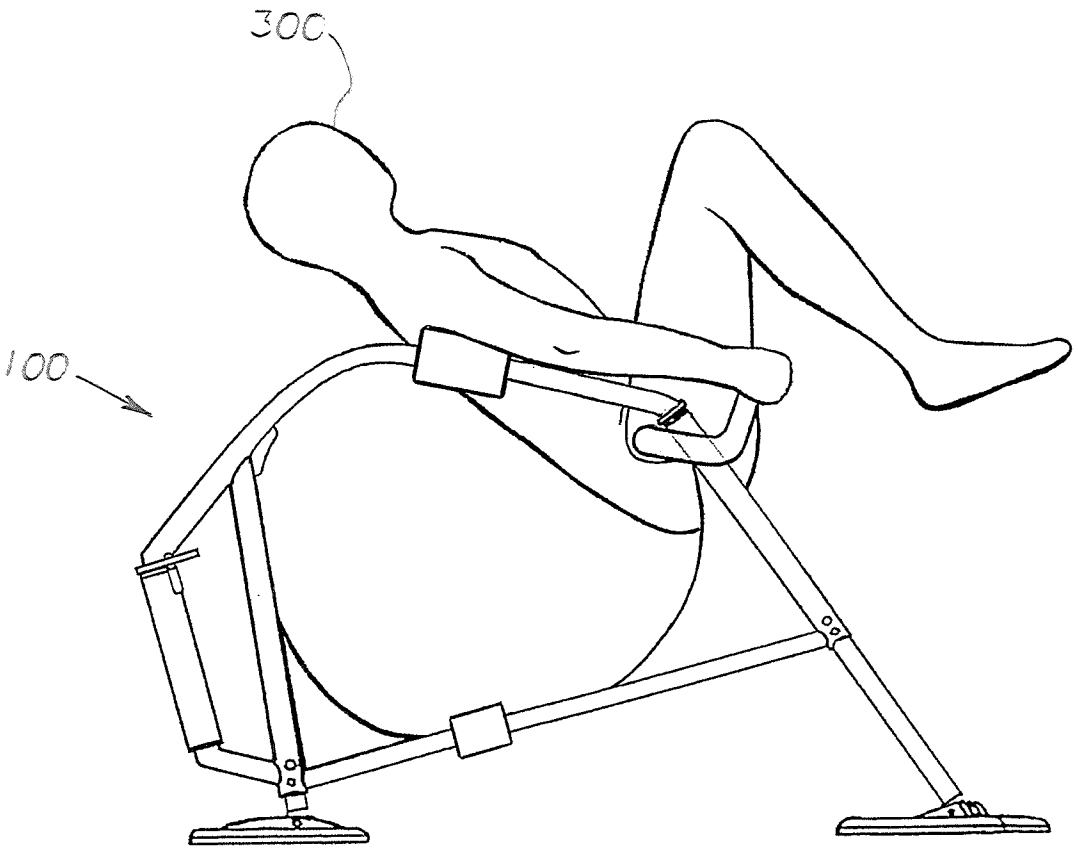
FIG. 19 is an illustration of an exerciser in a supine position and supported by the two upper support bars, gripping the first handles and performing abdominal crunches with the legs retracted.
Figure 20:
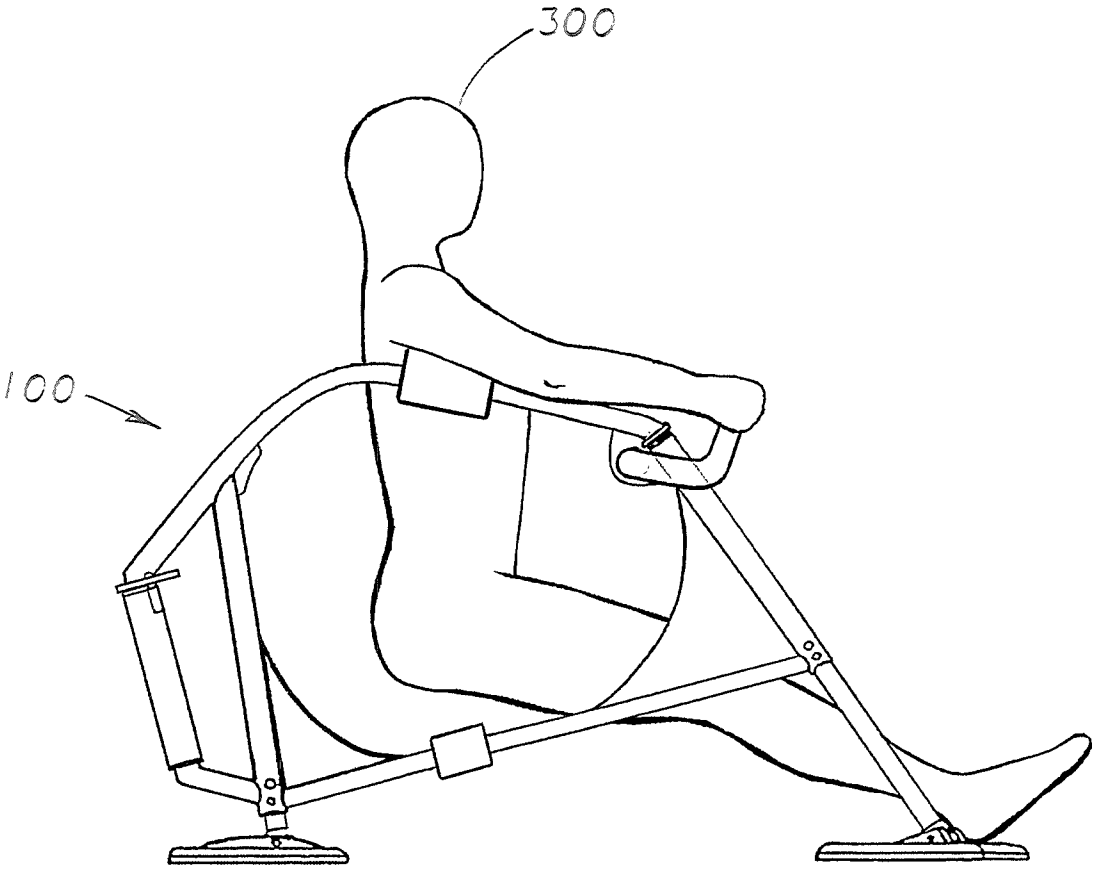
FIG. 20 is an illustration of an exerciser in a supine position and supported by his two aims on the two upper support bar, gripping the first handles, and performing abdominal crunches.
Figure 21:
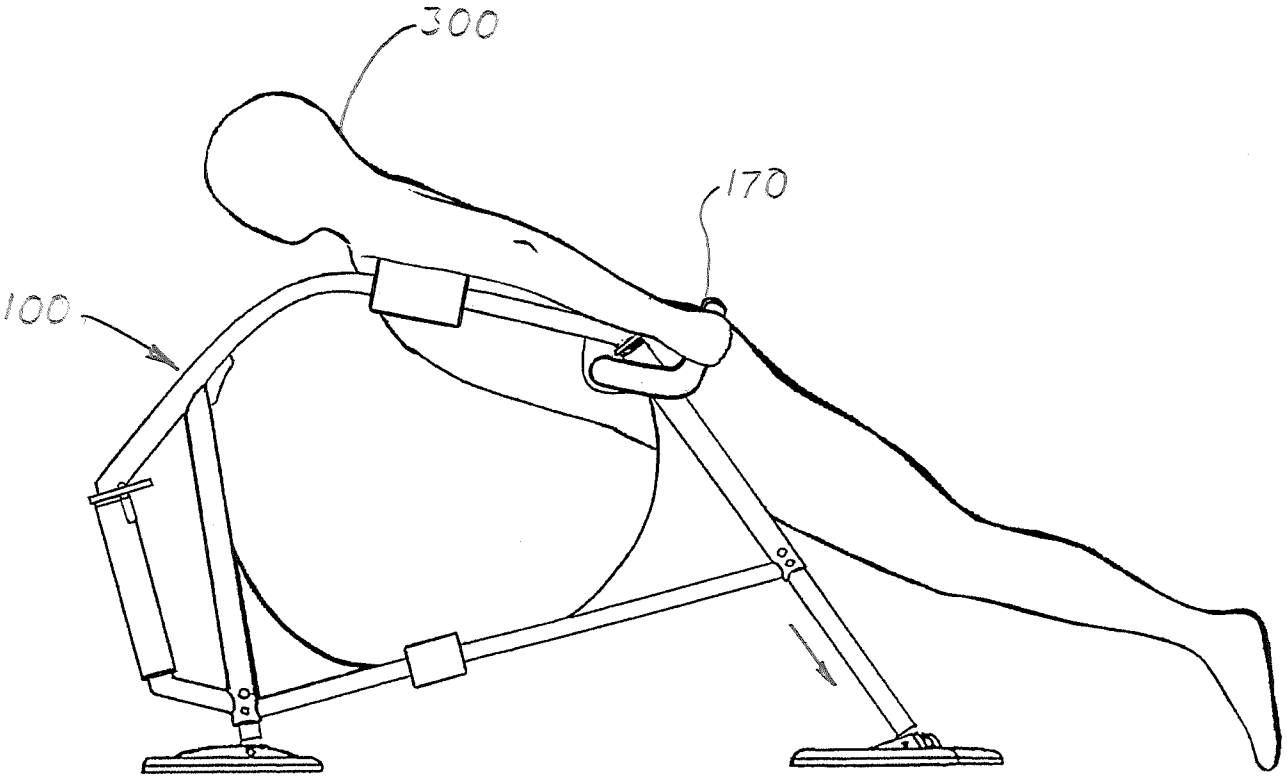
FIG. 21 an illustration of an exerciser in a prone position and supported by his two arms on the two upper support bars, gripping the first handles and straightening and extending both legs outward.
Figure 22:
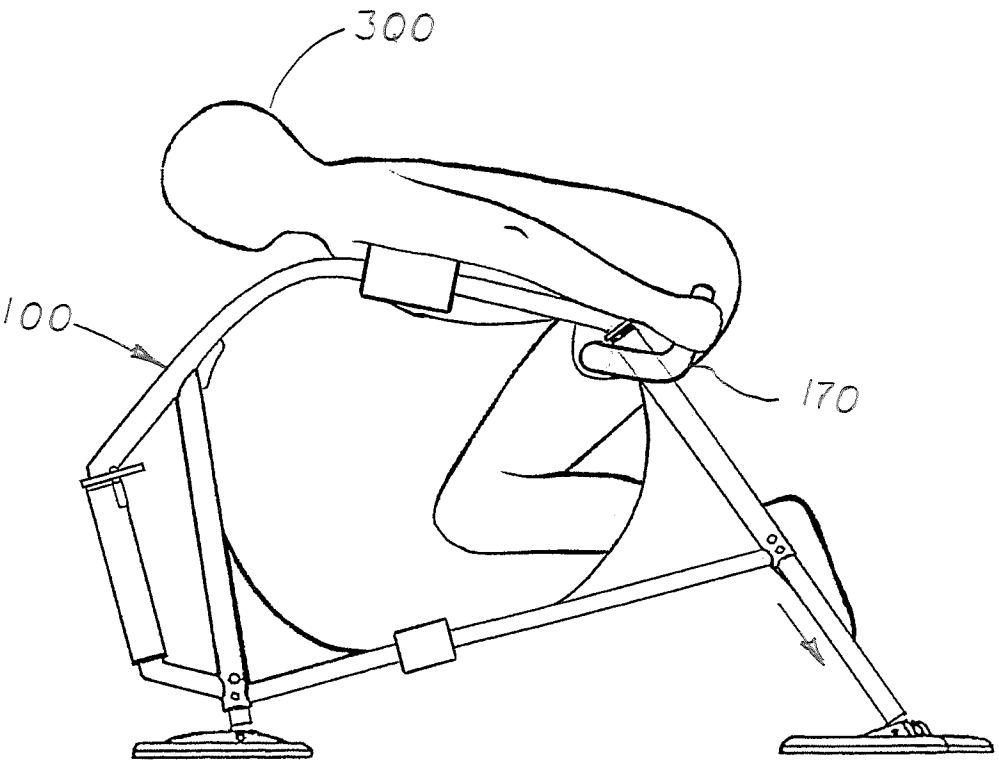
FIG. 22 is an illustration of an exerciser in a prone position and supported by his two arms on the two upper support bars, gripping the first handles and retracting both legs under the abdomen.
Figure 23:
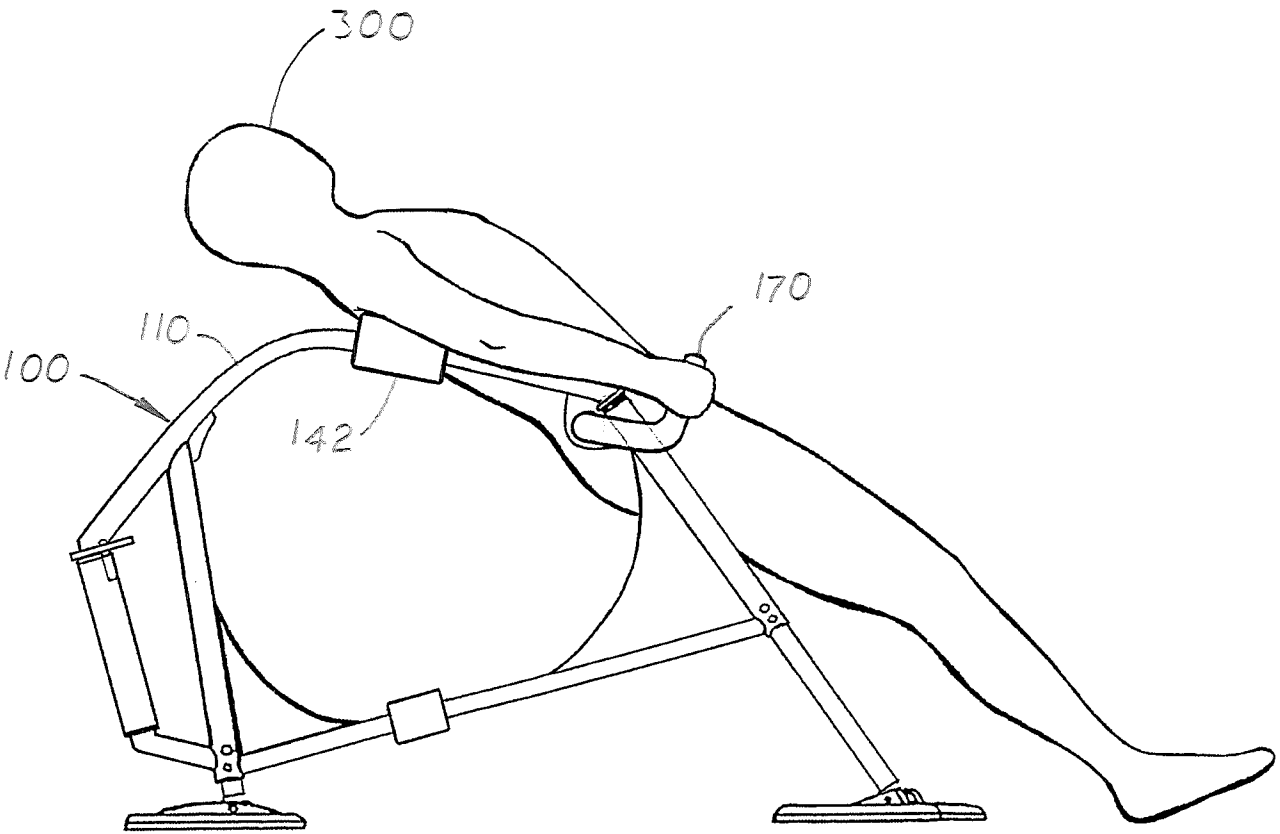
FIG. 23 an illustration of an exerciser in a supine position and supported by his two arms on the two upper support bars, and gripping the first handles and straightening and extending both legs outward.
Figure 24:
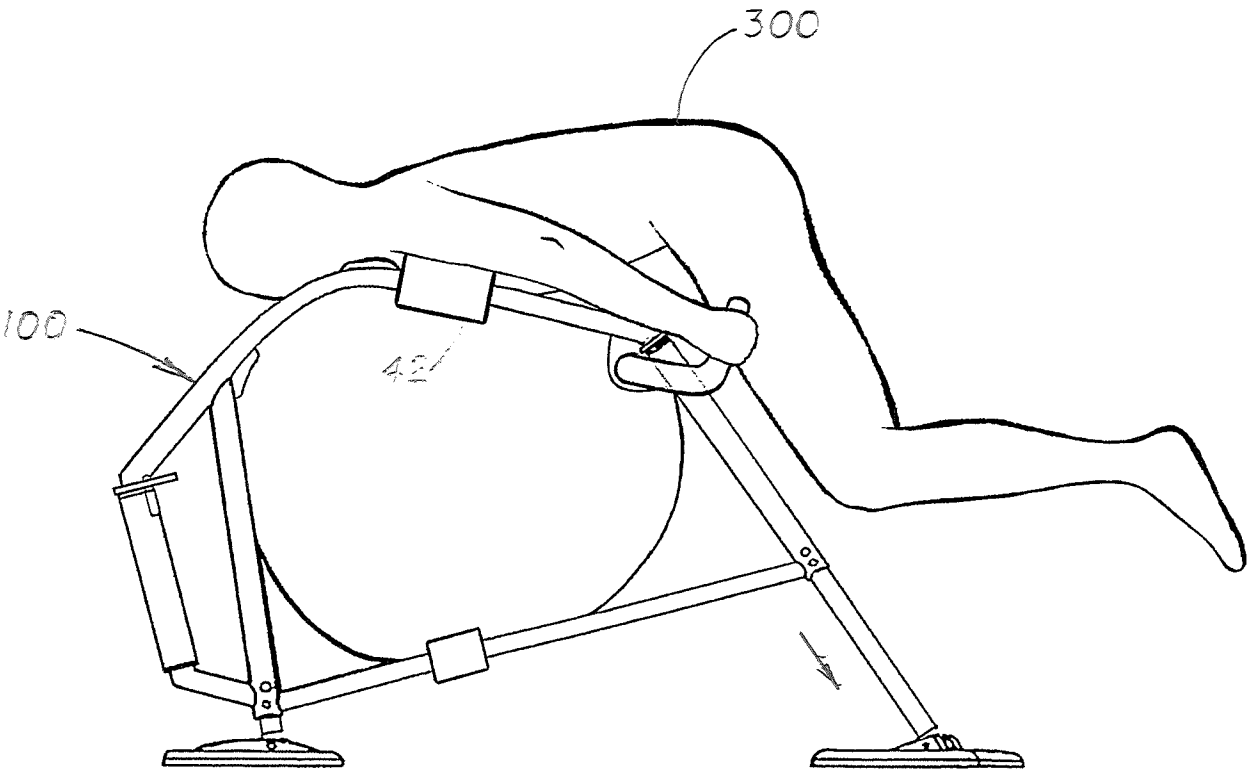
FIG. 24 an illustration of an exerciser in a prone position and supported by his two arms on the two upper support bars and using his hands to grip the first handles and retracting both legs.
Figure 25:
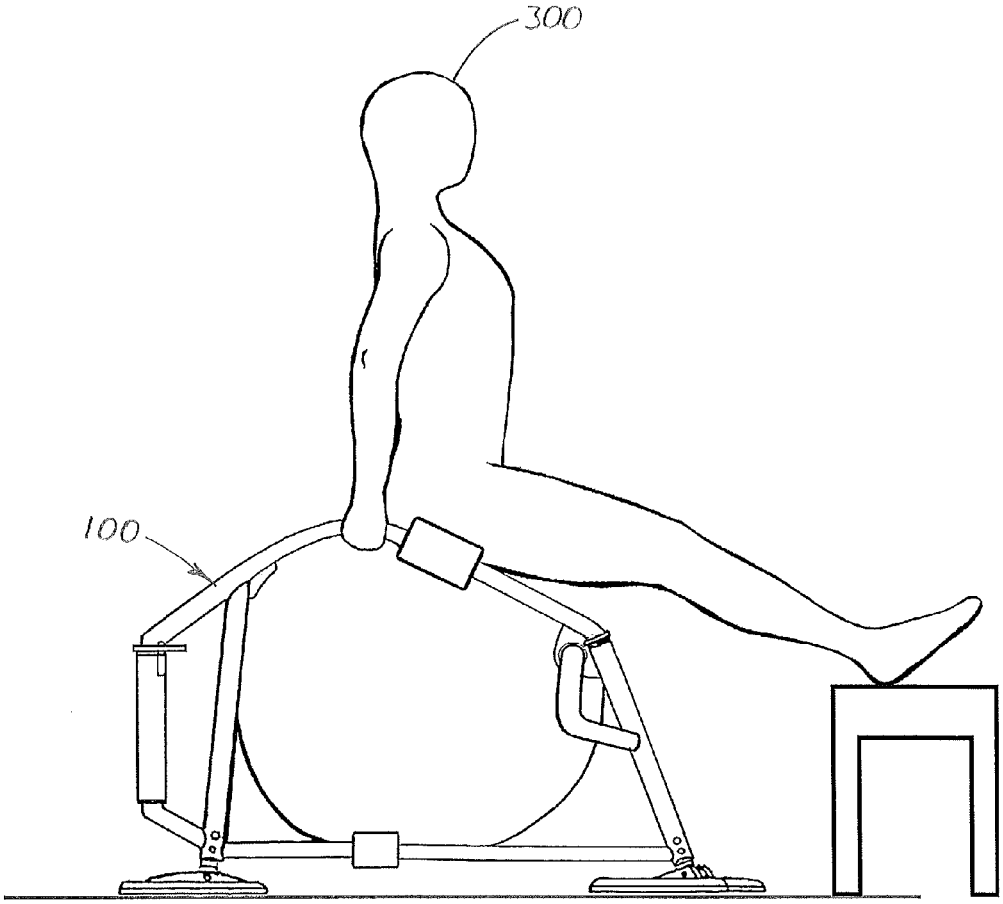
FIG. 25 an illustration of an exerciser in a sitting position and supported by his two arms on the two upper support bars and placing both feet on a table.

When setup, the two frame supports 102, 102' are vertically aligned and slightly angled inward to provide support. The device 100 is made of lightweight material and designed to be setup in a semi-collapsed configuration, as shown in FIG. 10, or in one of two fully collapsed configuration as shown in FIGS. 11 and 12.

The device 100 is designed so the exerciser 300 may perform different callisthenic exercises. Representative exercises that may be used with the device are illustrated in FIGS. 13-34. For any exercise, the exerciser 300 may adjust the length of the connector bars so that the front sections of the two frame supports 102, 102' are sufficiently spaced apart for a desired exercise. Each frame support 102, 102' can be easily rotated so the rear section of the device 100 is at the desired spacing apart. The angle of each frame support 102, 102' can be independently adjusted so the rear section of each frame support 102, 102' may be spaced apart a sufficient distance to accommodate a specific exercise. The lengths of the front and rear legs 134, 138' may be independently adjusted so each frame support 102. 102' is disposed at an angle desired for the exercise. When performing a callisthenic exercise, the exerciser 300 may use the upper support bar 110, the lower support bar 120, or the two handles 170. After performing the callisthenic exercise, the exerciser 300 can easily adjust the spacing of the front and rear sections, and the lengths of the front and rear legs 134, 138, respectively, and the angles of the two handles 170 to perform the next desired exercise. In the embodiment shown, the handles 170 attached to each frame support 102, 102' are L-shaped and may be rotated and locked in different positions for use with different exercises. In one embodiment, a handle plate 186 may be attached to the frame supports 102, 102', and holes may be formed in the handle plate 186 and pins and are inserted to hold the handle in the desired position on the handle plate 186.

As shown FIGS. 1-10, optional gussets 190, 192 may be installed on the front and rear sections of each frame support 102, 102' to provide additional support.

Figure 26:
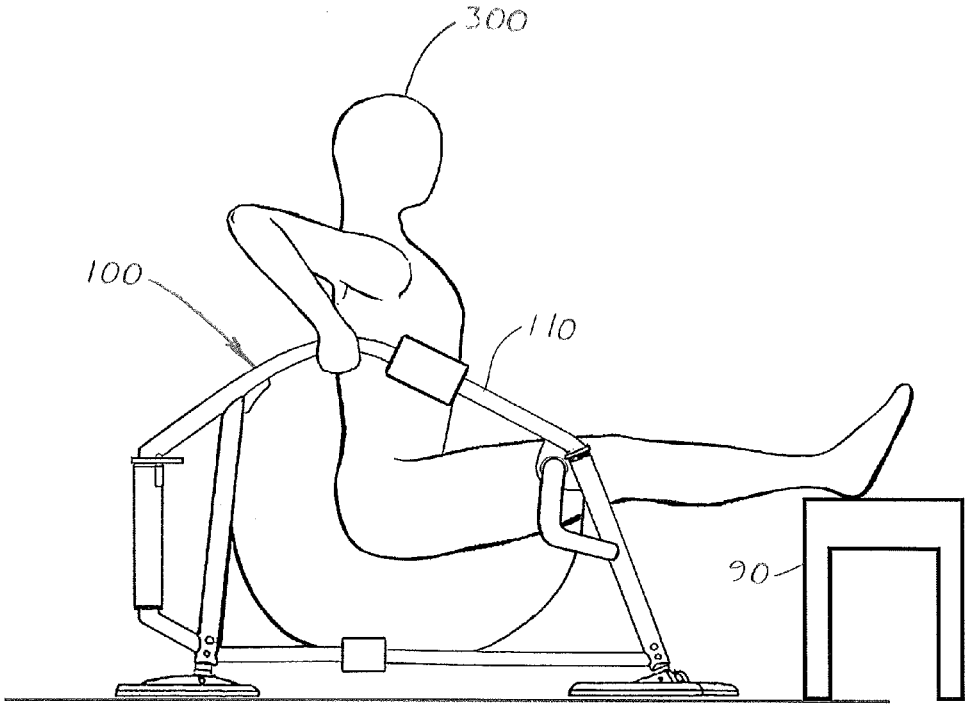
FIG. 26 an illustration of an exerciser in a sitting position and supported by his two arms on the two upper support bars and placing both feet on a table and performing dips.
Figure 27:
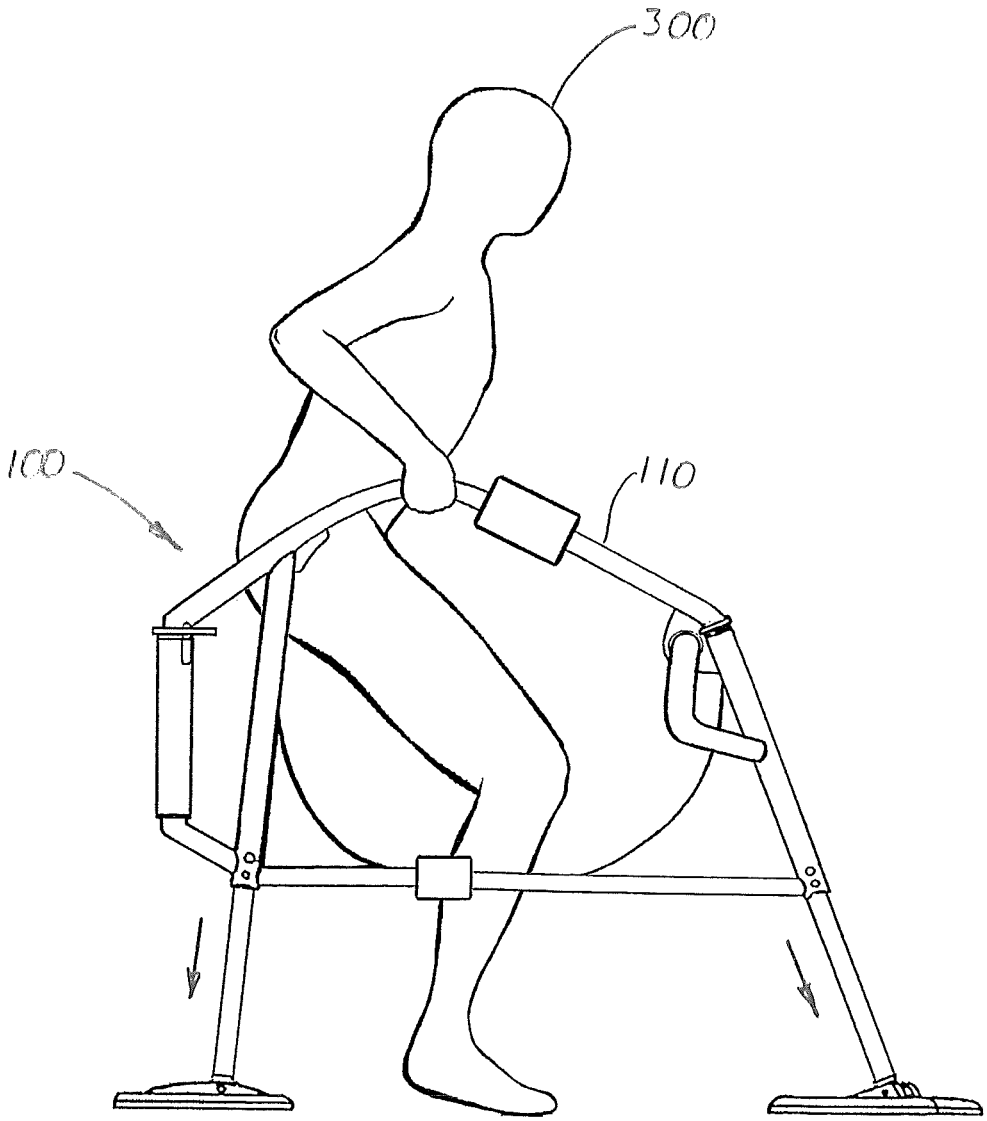
FIG. 27 an illustration of an exerciser standing and squatting rearward while being supported by his two hands gripping the two upper support bars.
Figure 28:
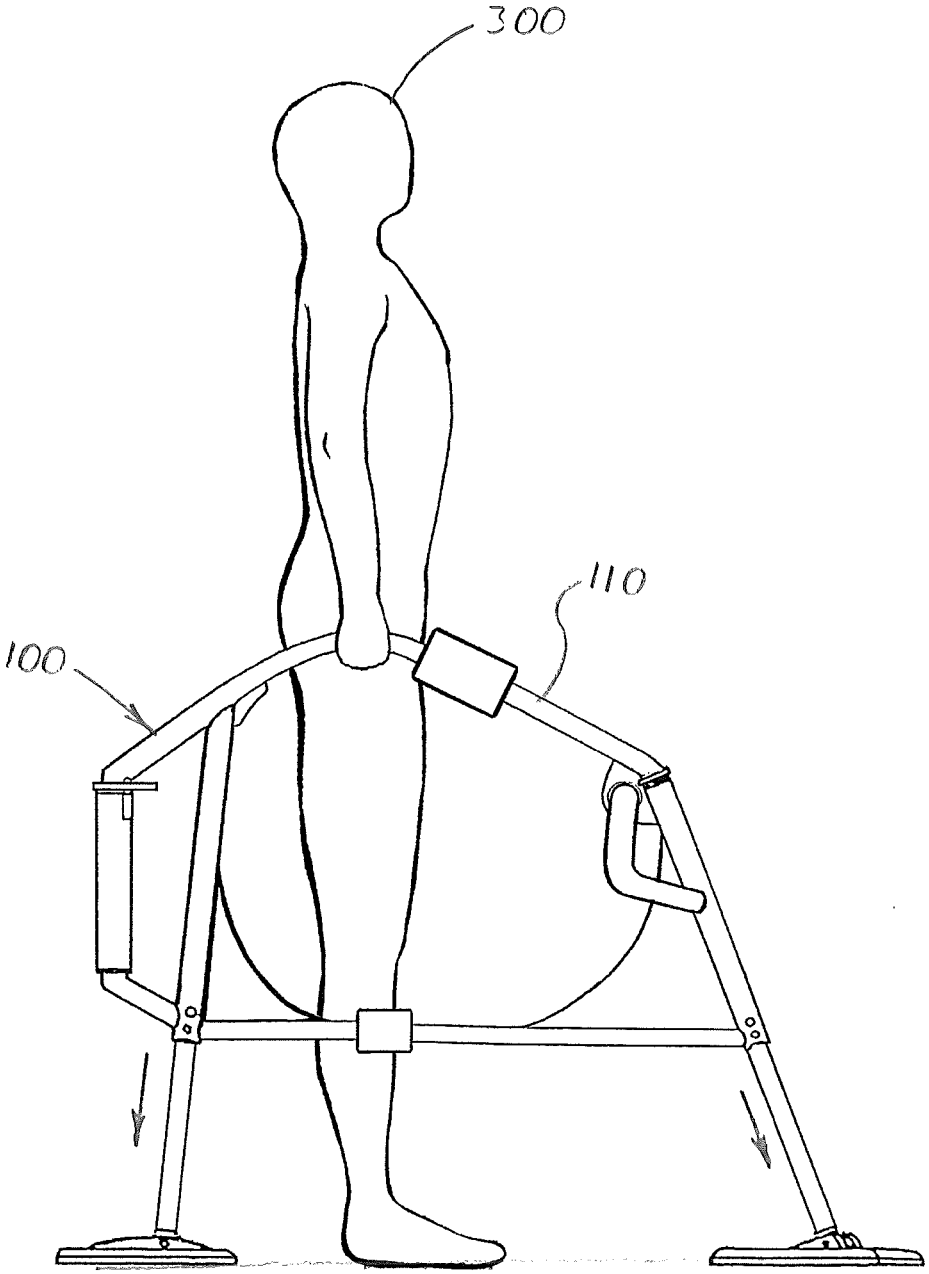
FIG. 28 an illustration of an exerciser standing upright and stretching while supported by his two hands gripping the two upper support bars.
Figure 29:
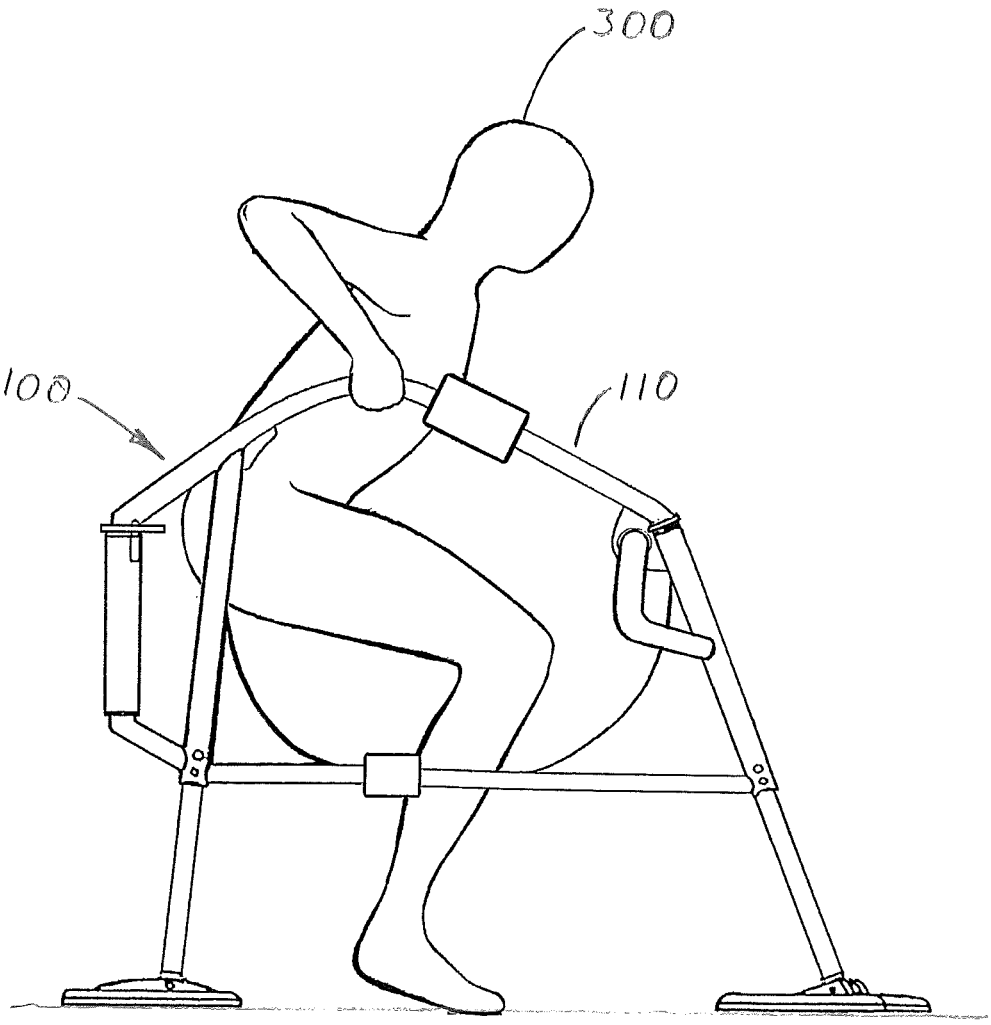
FIG. 29 an illustration of an exerciser standing and sitting rearward while being supported by his two hands gripping the two upper support bars.
Figure 30:
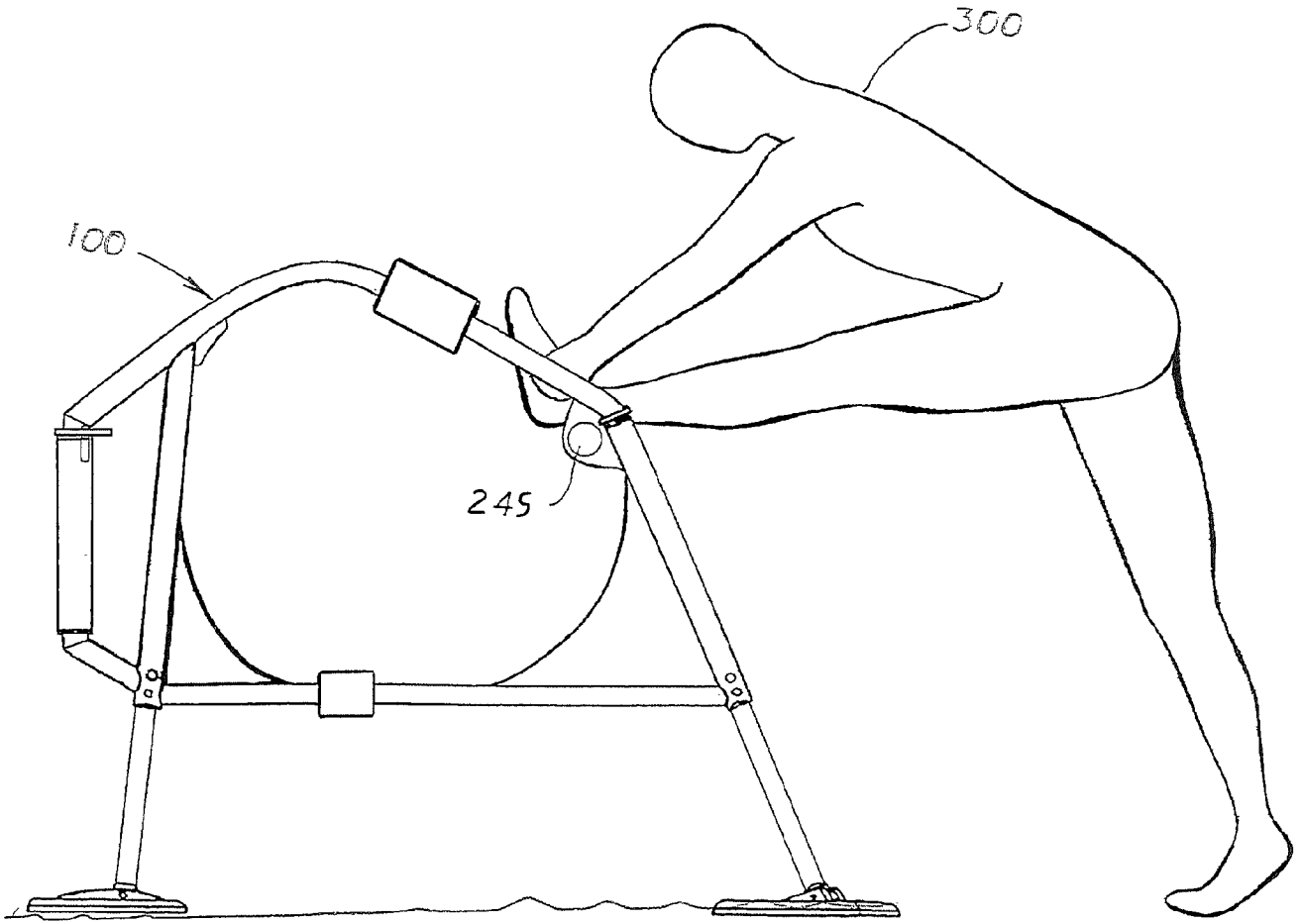
FIG. 30 an illustration of an exerciser placing his leg over a horizontal bar that extends between the two support members and stretching.
Figure 31:
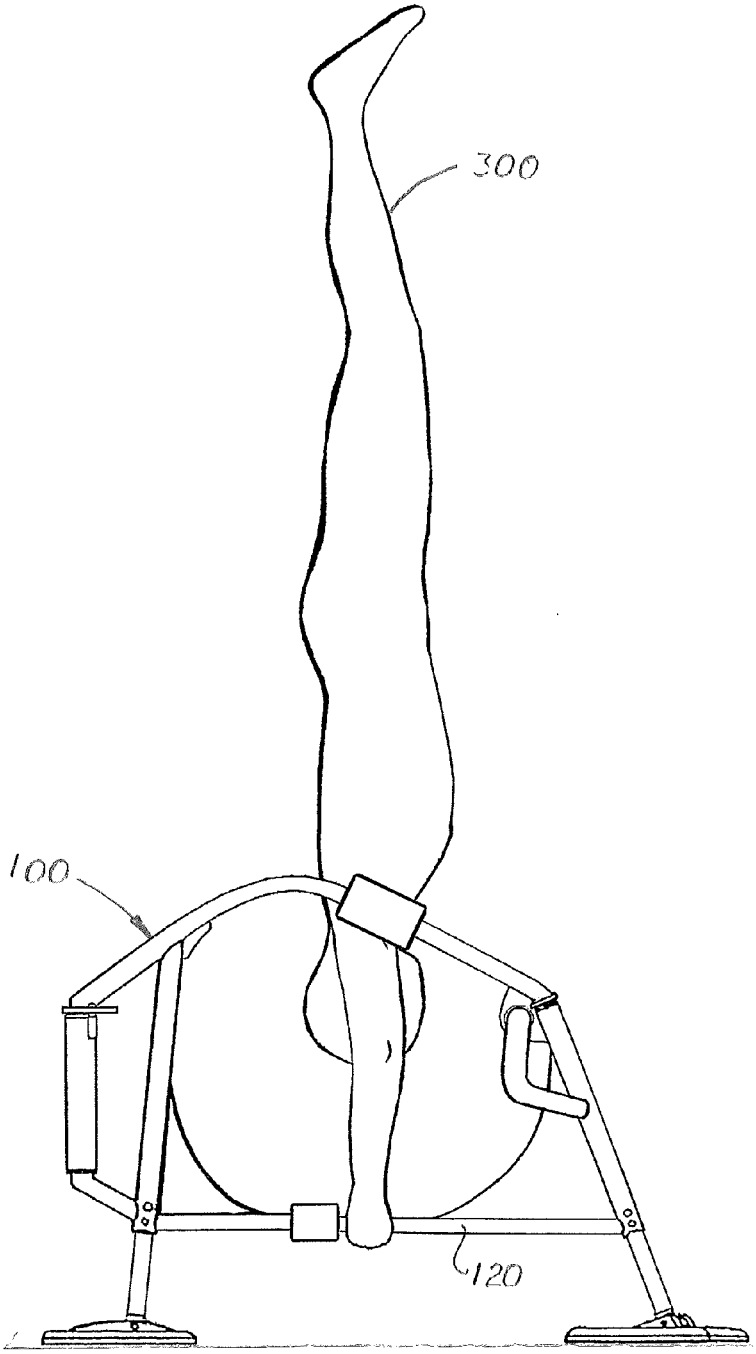
FIG. 31 an illustration of an exerciser in a vertical upside down position with his two hands supported on the two lower support bars.
Figure 32:
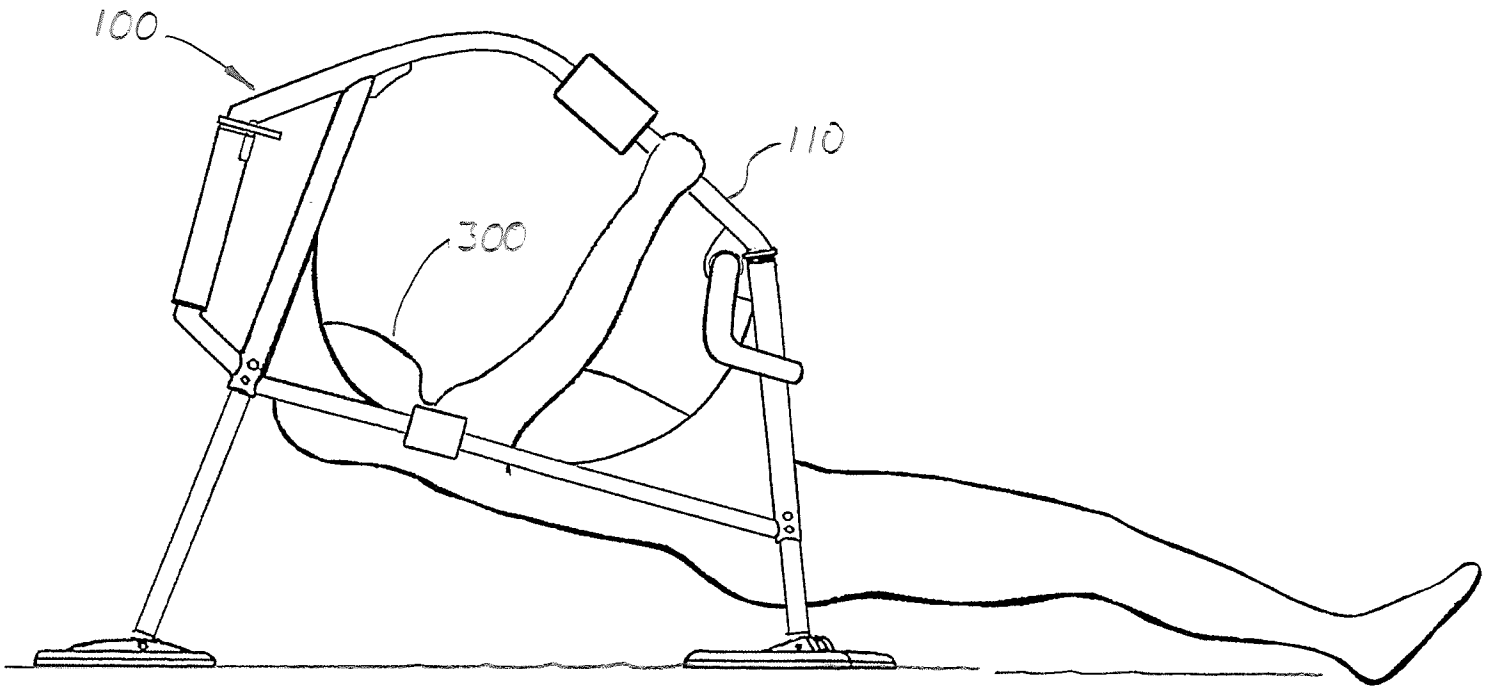
FIG. 32 is an illustration of an exerciser in a supine position with his two hands gripping the two upper support bars and holding his upper torso in an upward position off the floor while his feet are supported by the floor.
Figure 33:
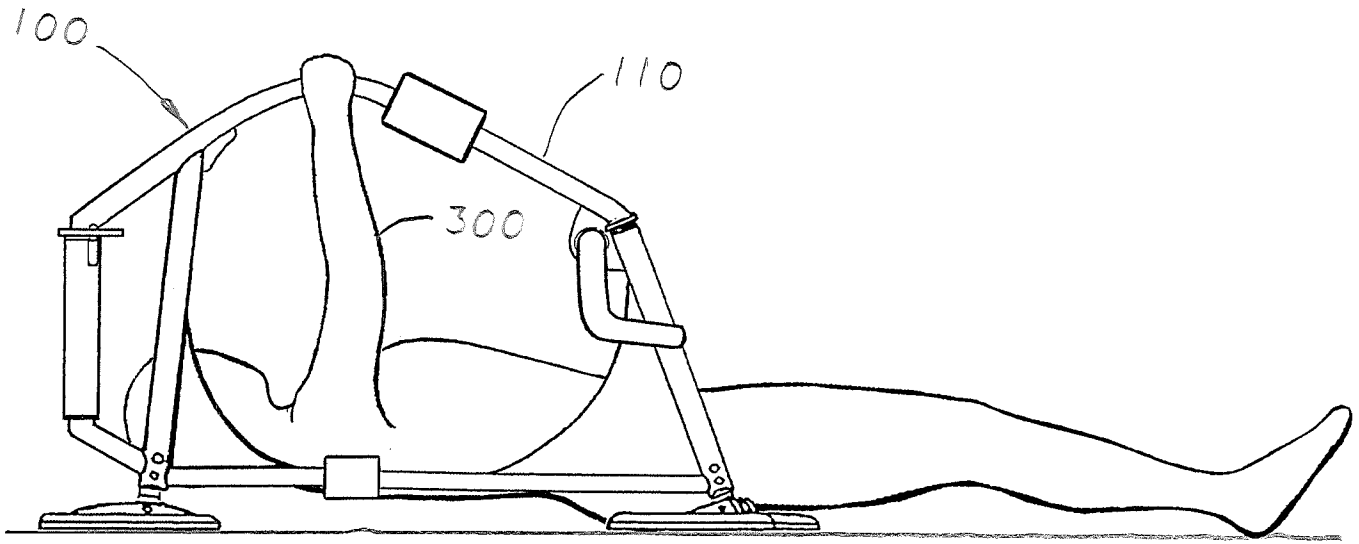
FIG. 33 is an illustration of an exerciser in a supine position with his two hands gripping the two upper support bars and his upper torso and his legs are supported by the floor.
Figure 34:
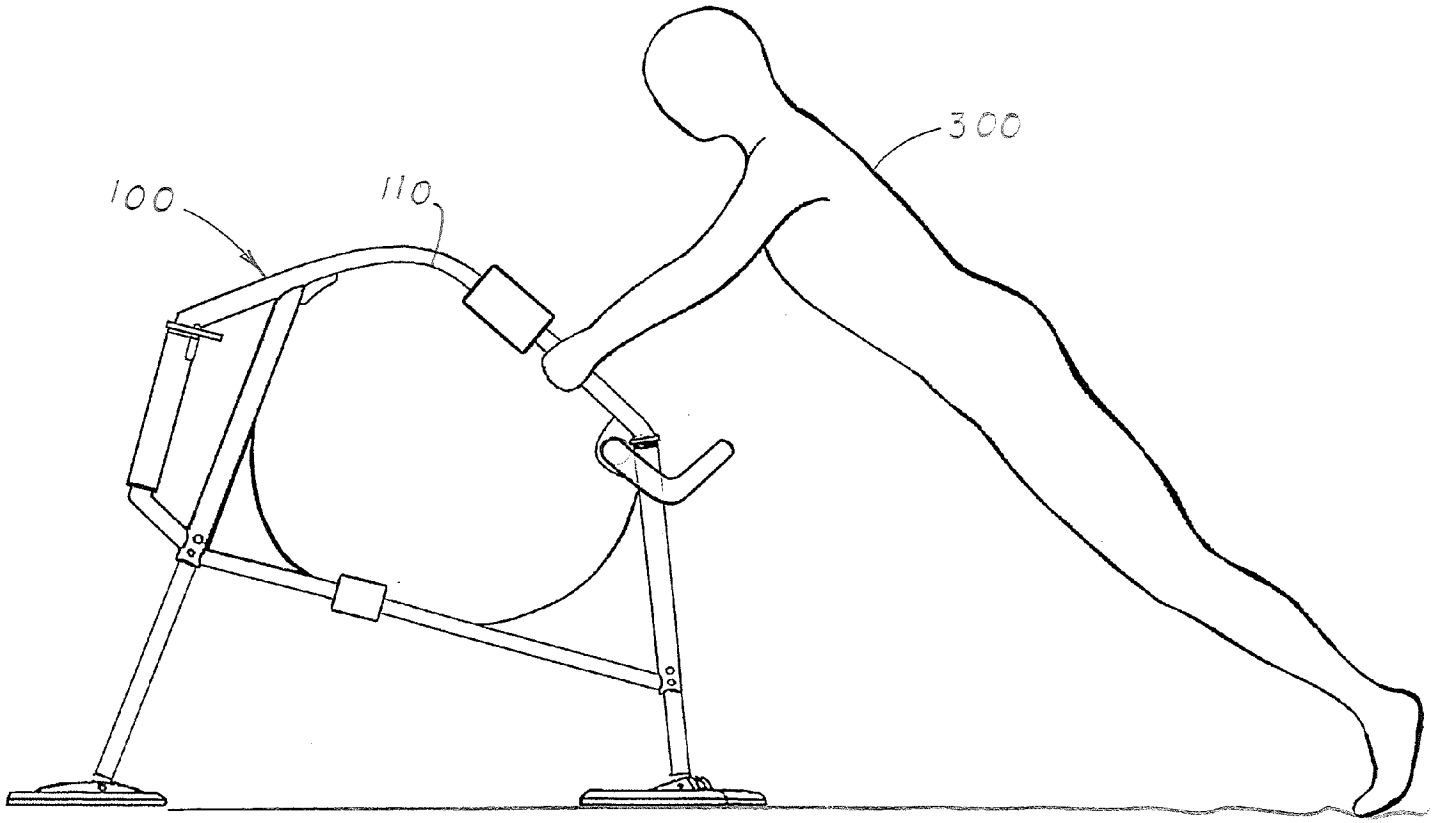
FIG. 34 is an illustration of an exerciser leaning forward with his arms gripping the two upper support bars and his feet are positioned on the floor.

FIG. 26 an illustration of an exerciser 300 in a sitting position and supported by his two arms on the two frame supports 110 and placing both feet on a table 90 and performing dips.

Figure 35:
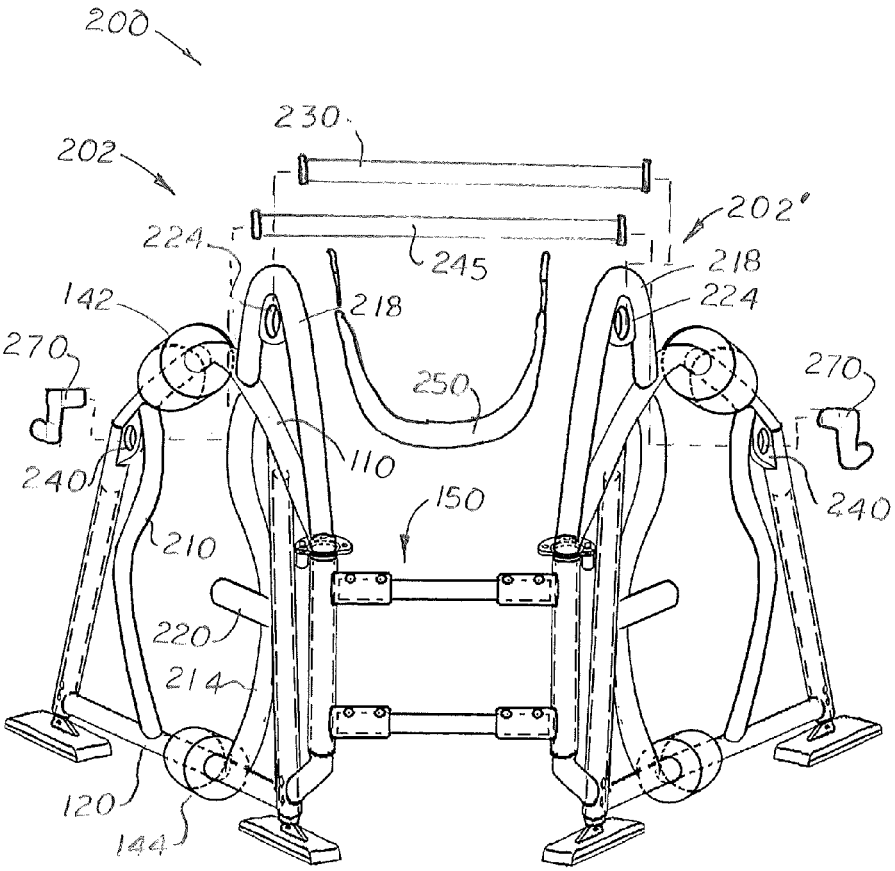
FIG. 35 is a front perspective view a second embodiment of the device

FIG. 35 is a front perspective view a second embodiment of the device (indicated by the reference number 200), that contains the same structural components used in the first embodiment (device 100) with each frame support 202, 202' being modified to include two vertically aligned interior bars 210, 214, a front extension bar 218 with a receiver hole 224 configured to receive a transversely aligned horizontal bar 230. Mounted on the front interior bar 214 is an optional handle 220. Device 200 may also include a second receiver hole 240 formed on the rear section of the frame support 202 configured to receive either a handle 270, the end of a horizontal bar 245, or two connecting straps 255 attached to the opposite ends of a suspension seat 250.

Figure 36:
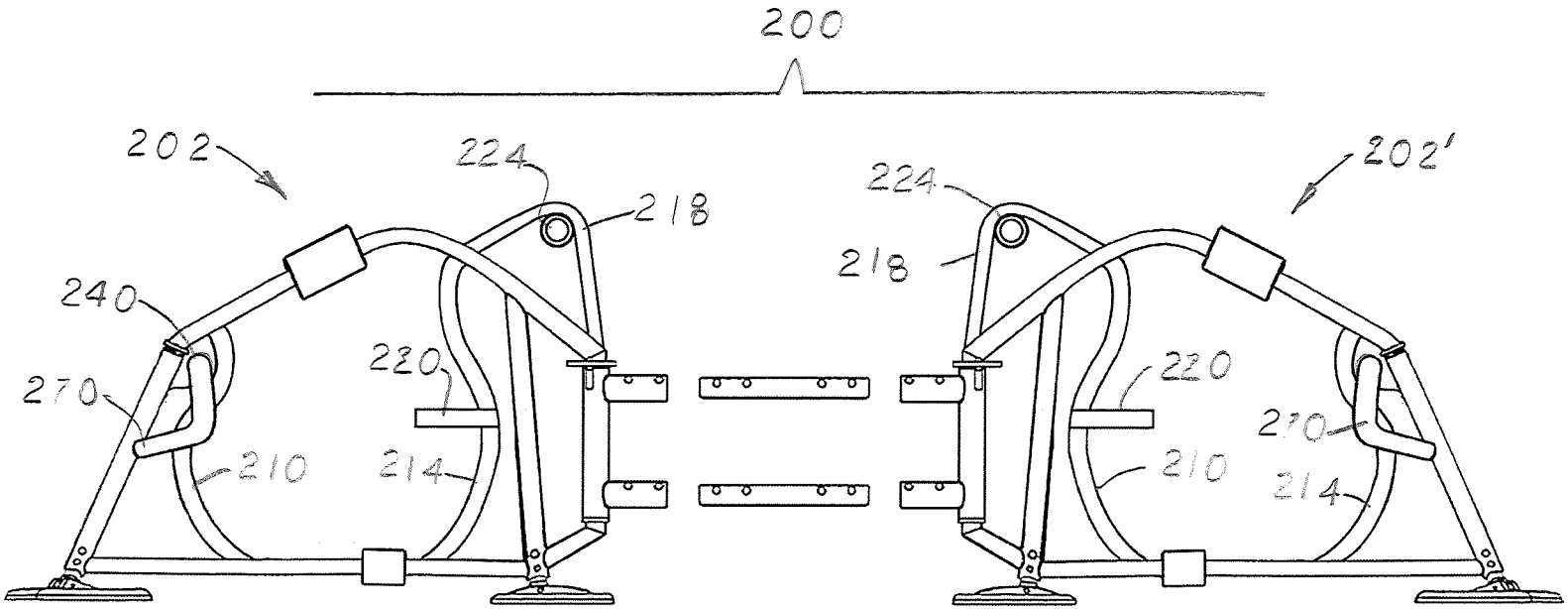
FIG. 36 is an exploded side elevational view of the device shown in FIG. 35.

FIG. 36 is an exploded side elevational view of the device 200 shown in FIG. 35.

Figure 37:
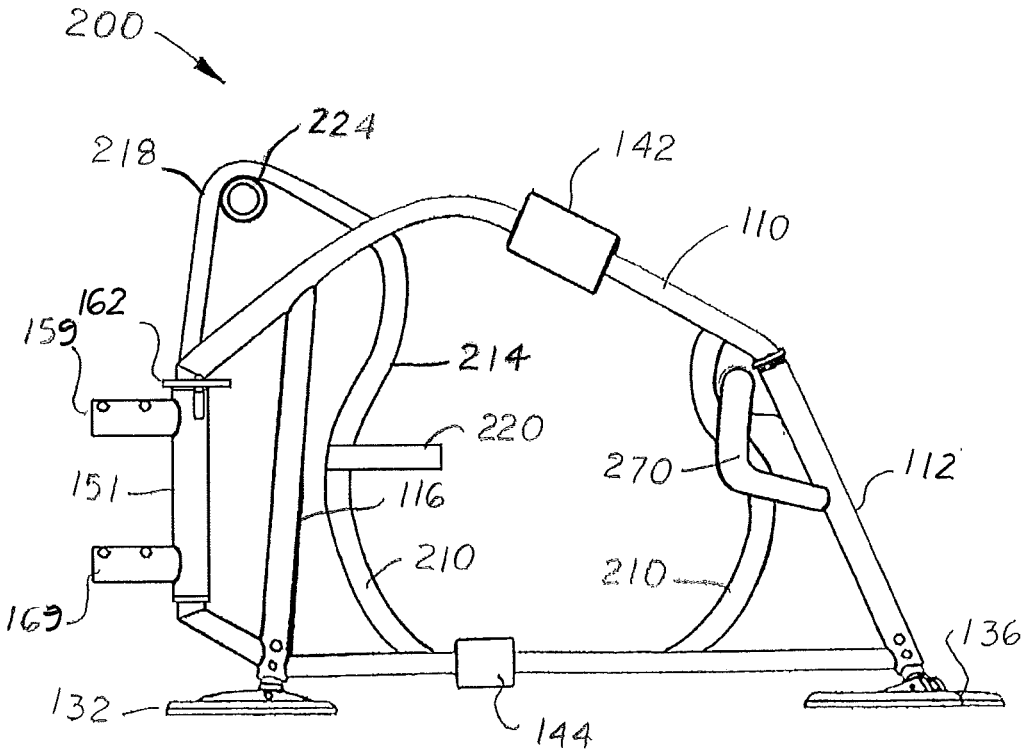
FIG. 37 is a side elevational view of the device shown in FIG. 35.

FIG. 37 is a side elevational view of the device 200 shown in FIG. 35.

Figure 38:
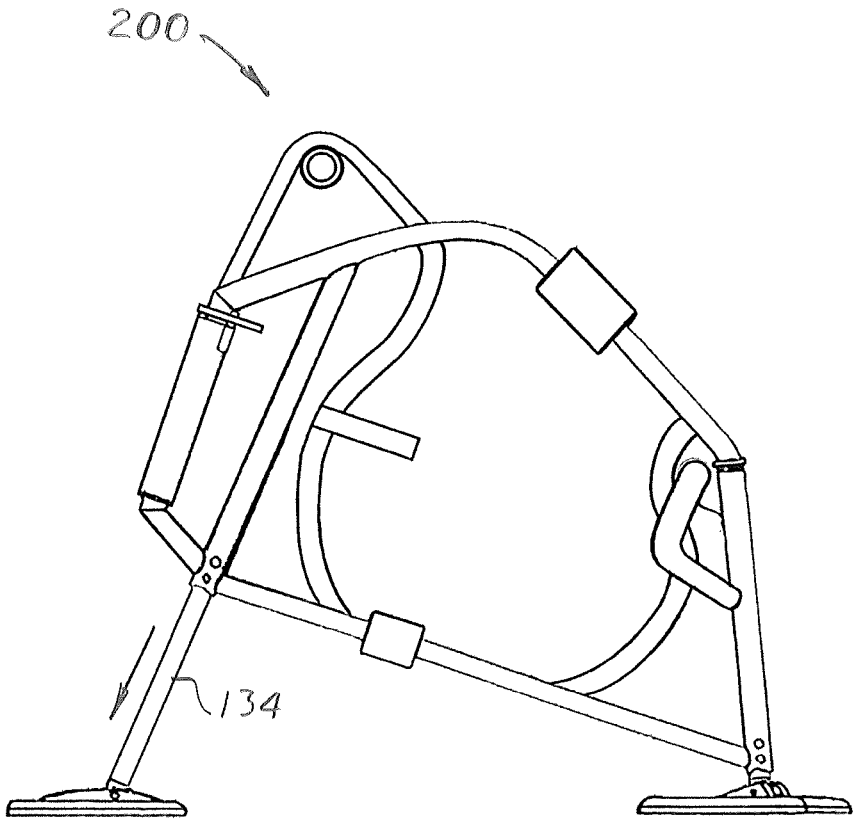
FIG. 38 is a side elevational view of the device shown in FIG. 35 with the front leg extended.

FIG. 38 is a side elevational view of the device 200 shown in FIGS. 35-37 with the front leg 134 extended thereby elevating the front section of the device 200.

Figure 39:
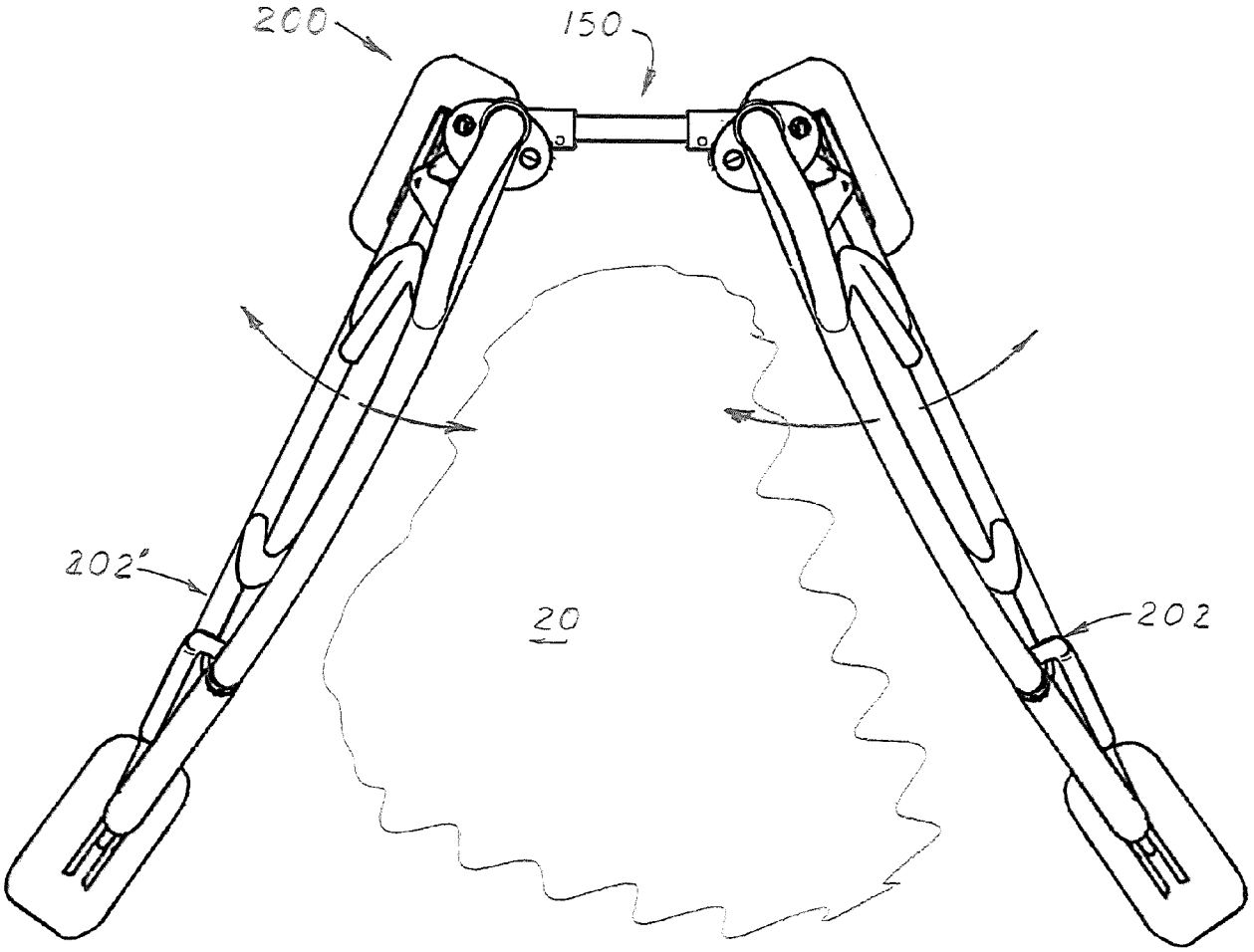
FIG. 39 is a top plan view of the device shown in FIG. 35 with the two frame supports diverging.

FIG. 39 is a top plan view of the device 200 shown in FIG. 35 with the two frame supports 202, 202' rotating around the opposite ends of the front fork 150 thereby changing the size of the exercise area 20.

Figure 40:
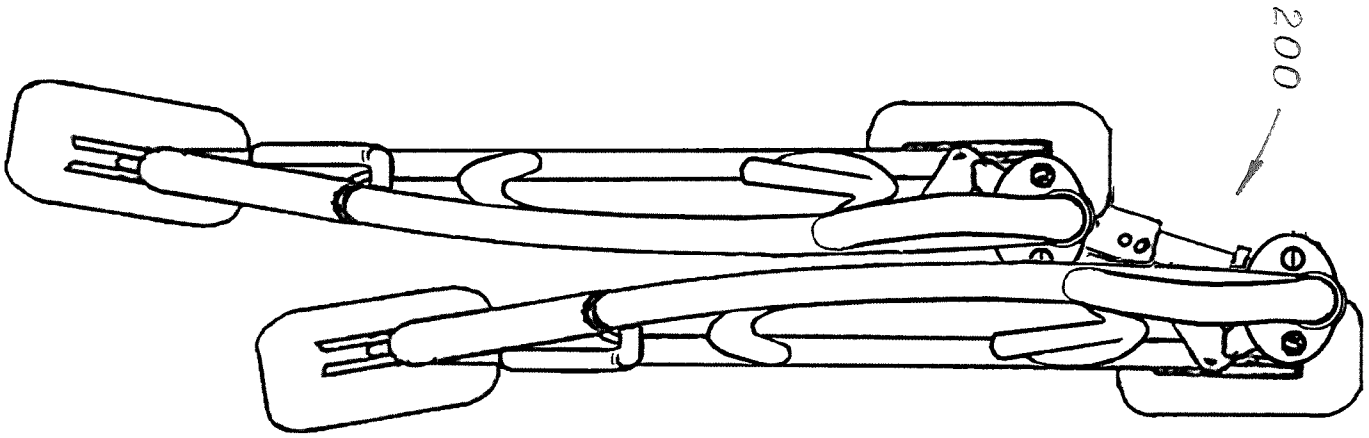
FIG. 40 is a top plan view of the device showing the two frame supports rotated inward and parallel.
Figure 41:
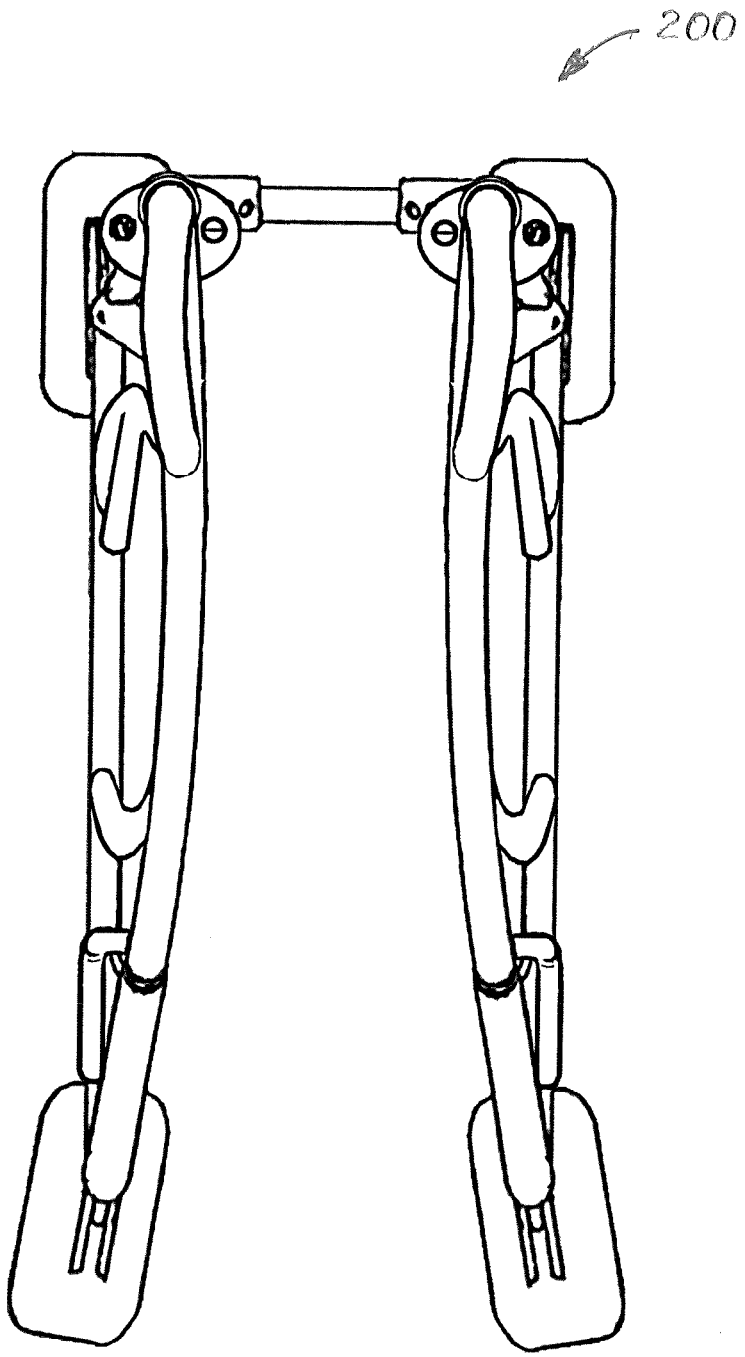
FIG. 41 is a top plan view of the device showing the two frame supports perpendicularly aligned with the fork assembly and rotated into a parallel configuration.
Figure 42:
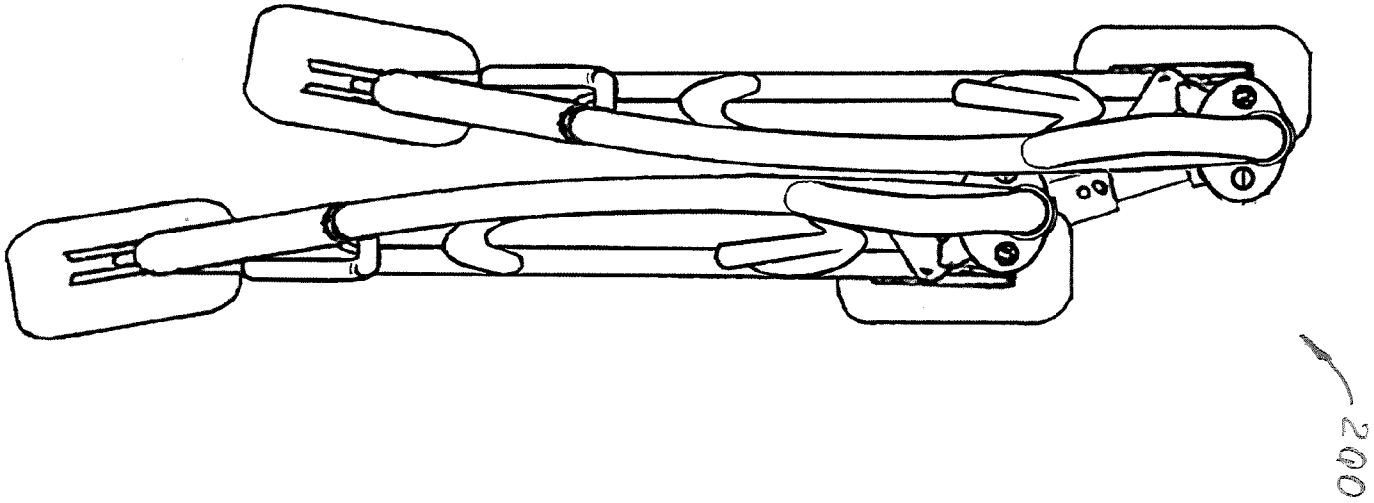
FIG. 42 is a top plan view of the device similar to the view shown in FIG. 40 that shows the two frame supports rotated inward and parallel.

FIGS. 40-42 are top plan views of the device 200 showing the two frame supports 202, 202' being adjusted on the front fork 150 to change their relative positions to each other.

Figure 43:
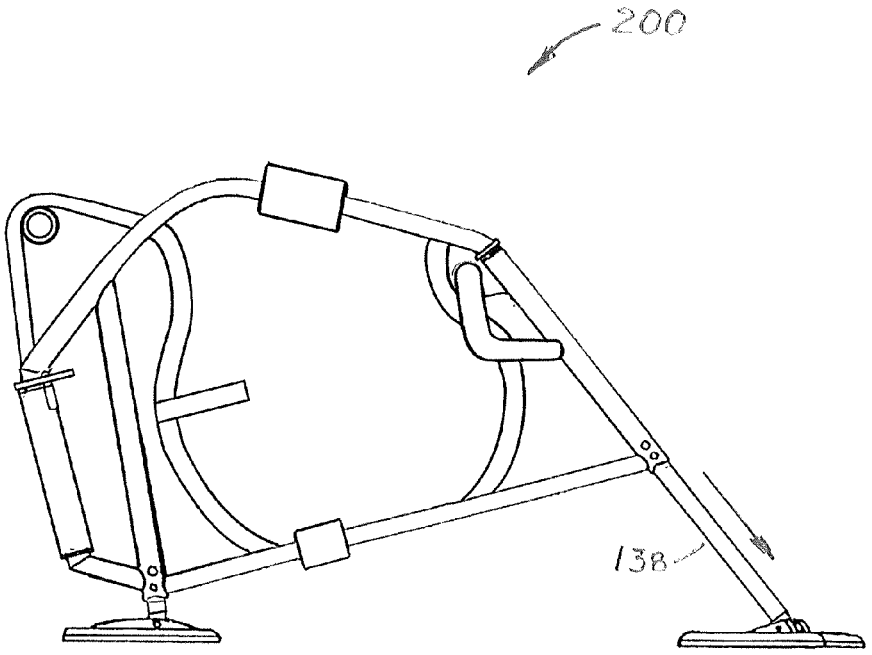
FIG. 43 is a side elevational view of the device in FIG. 35 with the rear leg extended.

FIG. 43 is a side elevational view of the device 200 in FIG. 35 with the rear leg 138 extended.

Figure 44:
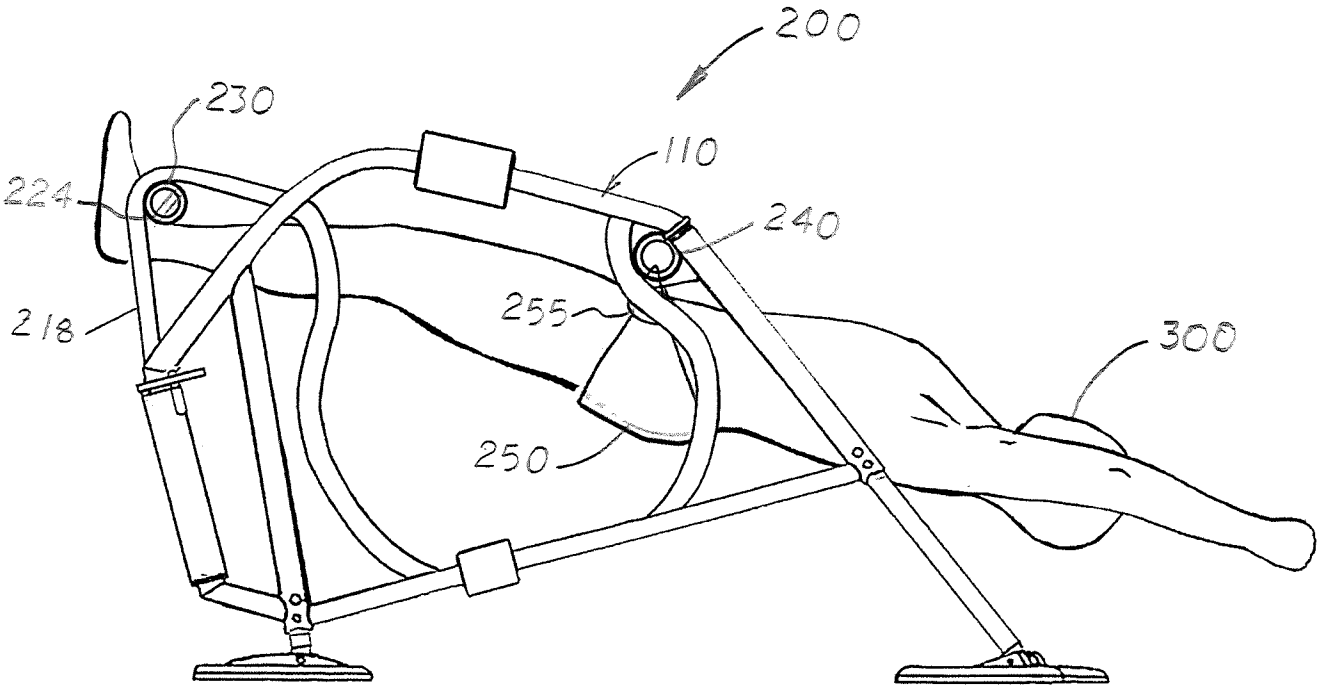
FIG. 44 is a side elevational view of the device with a suspension seat and one horizontal bar attached to the two frame supports and showing an exerciser in a supine position and supported by the seat with his legs extended under the horizontal bar.

FIG. 44 is a side elevational view of the device 200 shown in FIG. 43 with a suspension seat 250 and one horizontal bar 230 attached to the receiver hole 240 formed on the front extension bars 218 and showing an exerciser 300 in a supine position and supported by a suspension seat 250 attached to receiver holes 240 formed on the frame support 110 and with his legs extended under the horizontal bar 230.

Figure 45:
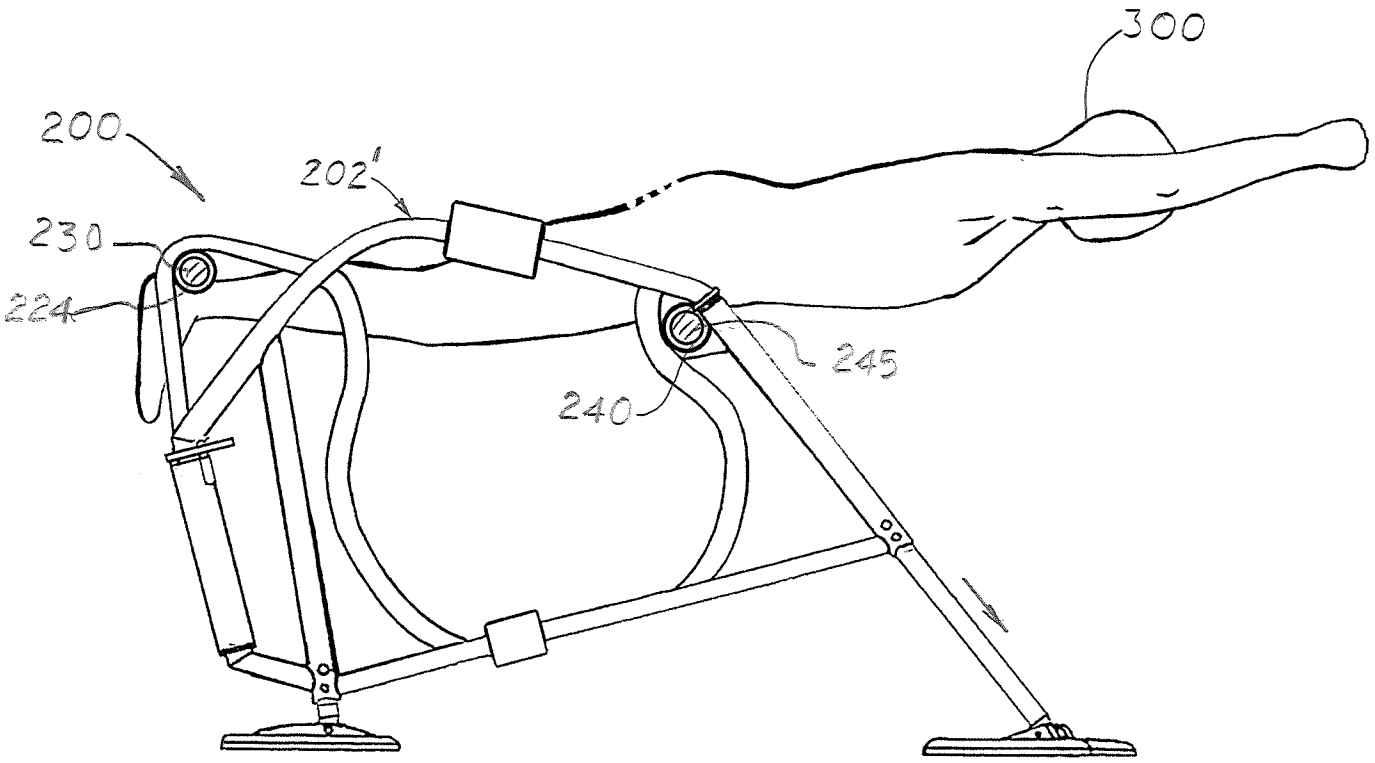
FIG. 45 is a side elevational view of the device with two horizontal bars attached to the two frame supports and showing an exerciser in a prone position with his legs extended under the front horizontal bar and his waist extended over the top of the rear horizontal bar and performing back flex extensions.

FIG. 45 is a side elevational view of the device 200 with two horizontal bars 230, 245 attached to the two receiving holes 224, 240, respectively, and showing an exerciser 300 in a prone position with his legs extended under the front horizontal bar 230 and his waist extended over the top of the rear horizontal bar 245.

Figure 46:
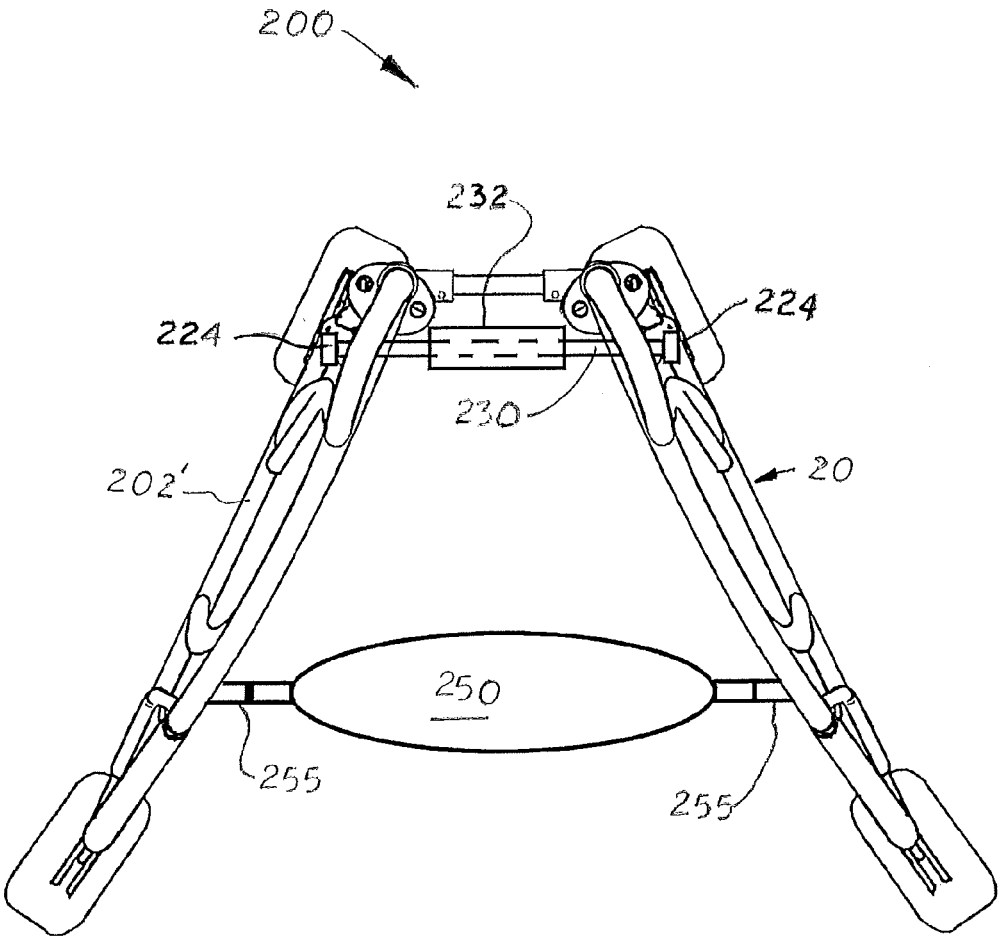
FIG. 46 is a top plan view of the device shown in FIG. 44.

FIG. 46 is a top plan view of the device 200 shown in FIG. 44. An optional elongated pad 232 is longitudinally aligned over the front horizontal bar 230 to provide greater comfort.

Figure 47:
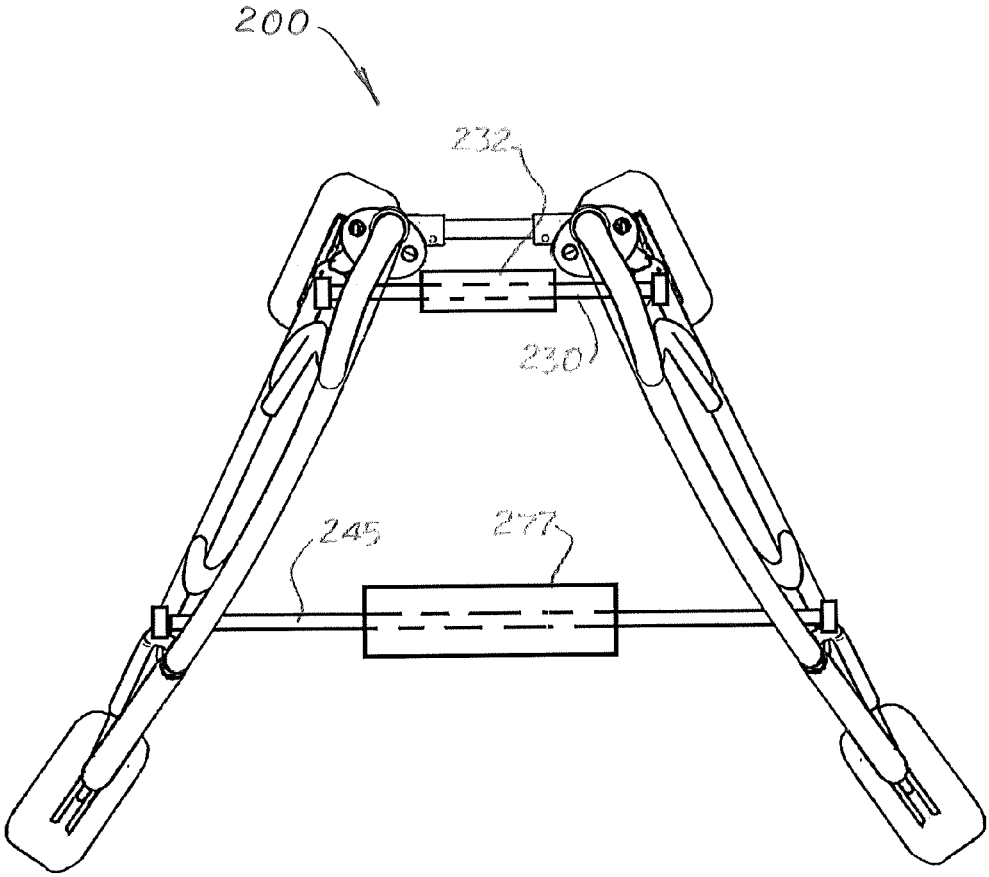
FIG. 47 is a top plan view of the device shown in FIG. 45.

FIG. 47 is a top plan view of the device 200 shown in FIG. 45 with an elongated pads 232, 277 attached to the front and rear horizontal bars 230, 245, respectively.

As shown in FIG. 35, the device 200 may include handles 270 designed to be selectively attached to the receiving holes 224 or 240. In one embodiment, each handle 270 may include a locking or clamp mechanism that allows the handle 270 to rotate to place the handle 270 in a comfortable position for the exerciser 300.

In the two embodiments shown, the frame supports 102, 102' and 202, 202' are made of 1½ inch diameter (O.D.) tubing. Each frame support 102, 102, 202 and 202' is measures 36 to 60 inches in length and 24 to 60 inches in height. The extension legs 134, 138 may extend 4 to 12 inches in length. Each foot pad 132, 136 measures approximately 12 inches in length and 4 inches in width.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. An adjustable device for performing callisthenic exercises, comprising:

a. a right upright frame support and a left upright frame support, each said frame support includes an upper curved bar, a lower support bar, and a front tube extending between said upper curved bar and said lower support bar, each said frame support includes a front leg axially aligned with said front tube and a rear leg that supports said frame support on a support surface in an upright position and enables said frame supports to be angled inward to support a user performing callisthenic exercises on said device;

b. a front extension on each said frame support located in front of said front leg, each said front extension includes an upper extension arm, a lower extension arm and a vertical arm that extends between said upper extension arm and said lower extension arm;

c. a front fork disposed between said front extensions on said frame supports, said front fork includes two vertically aligned outer tubes and at least two horizontal tubes, said outer tubes being coaxially aligned over said vertical arms on said front extensions thereby pivotally connecting said front extensions on said frame supports together; and, d. a hinge disposed between each said front extension and said front fork, said hinges configured to allow said frame supports to selectively rotate to adjust the angle between each of said frame supports and said front fork and then lock in a fixed position to perform different callisthenic exercises on said device.

2. The device as recited in claim 1, wherein said front legs are adjustable in length.

3. The device as recited in claim 2, wherein said rear legs are adjustable in length.

4. The device as recited in claim 1, wherein said rear legs are adjustable in length.

5. The device as recited in claim 1, further including a protective pad attached to each said upper curved bar.

6. The device as recited in claim 2, further including a protective pad attached to each said upper curved bar.

7. The device as recited in claim 3, further including a protective pad attached to each said upper curved bar.

8. The device as recited in claim 1, further including a protective pad attached to each said lower support bar.

9. The device as recited in claim 8, wherein said rear legs are adjustable in length.

10. The device as recited in claim 8, further including a protective pad attached to each said upper curved bar.

11. The device as recited in claim 9, further including a protective pad attached to each said upper curved bar.

12. The device as recited in claim 1, further including each said upright frame support includes an L-shaped handle.

13. The device as recited in claim 1, further including at least one cross bar configured to extend across said exercise space and supported by said frame supports.

14. The device as recited in claim 1, further including a suspended seat extending between said frame supports.

15. The device as recited in claim 1, further including a sling suspended between said frame supports.

16. The device as recited in claim 1, further including a front support handle attached to each said frame support.

17. The device as recited in claim 1, further including a front extension bar attached to each said frame support.

18. The device as recited in claim 1, wherein said front fork is adjustable in length.

19. The device as recited in claim 17, further including at least one cross bar extending between said front extension bars.

20. The device as recited in claim 1, wherein each said upright frame support includes a handle.

* * * * *